US005199694A

United States Patent [19]

Iseda

[11] Patent Number: 5,199,694

[45] Date of Patent: Apr. 6, 1993

[54] PAPER SHEET FEEDER

[75] Inventor: Ken Iseda, Yokohama, Japan

[73] Assignee: Kabushiki Kaisha Toshiba, Kawasaki, Japan

[21] Appl. No.: 734,207

[22] Filed: Jul. 22, 1991

[30] Foreign Application Priority Data

Jul. 23, 1990 [JP] Japan ..... 2-194203

[51] Int. Cl.[5] ..... B65H 3/44

[52] U.S. Cl. ..... 271/9; 271/242; 271/114; 271/126; 271/152

[58] Field of Search ..... 271/9, 10, 242, 114, 271/126, 127, 152

[56] References Cited

U.S. PATENT DOCUMENTS

| | | | |
|---|---|---|---|
| 3,977,666 | 8/1976 | Suzuki et al. | 271/9 |
| 4,548,394 | 10/1985 | Koyama et al. | 271/9 |
| 4,605,215 | 8/1986 | Hyltoft | 271/9 |
| 4,639,125 | 1/1987 | Okuda et al. | 271/291 X |

FOREIGN PATENT DOCUMENTS

| | | | |
|---|---|---|---|
| 61-192649 | 8/1986 | Japan | 271/242 |

*Primary Examiner*—David H. Bollinger
*Attorney, Agent, or Firm*—Limbach & Limbach

[57] ABSTRACT

An image forming apparatus is provided with a paper sheet feeder for selective feeding from a group of paper sheets in either a first or second cassette. In the paper sheet feeder, first and second registration rollers are provided in front of the first and second cassettes respectively, and a common registration roller is provided in front of a photosensitive drum. When the first group of paper sheets is selected, a first paper sheet is supplied to the first registration roller from the first cassette so that the paper sheet is registered by the first registration roller. The registered paper sheet is supplied to the common registration roller so that the paper sheet is also registered by the common registration roller. When the second group of paper sheets is selected, the second paper sheet is supplied to the second registration roller from the second cassette so that the paper sheet is registered by the second registration roller. The registered paper sheet is supplied to the common registration roller through the first registration roller so that the paper sheet is also registered by the common registration roller.

16 Claims, 22 Drawing Sheets

COPY RUN SIGNAL

SHEET PAPER FEED
REQUEST SIGNAL

REGISTRATION
ROLLER START
(R START) SIGNAL

SHEET PAPER
STOP SWITCH
H
L
H
L
H
L
OFF
ON
INTERNAL SIGNALS
SIGNALS FROM THE ELECTRONIC
PHOTO COPY UNIT

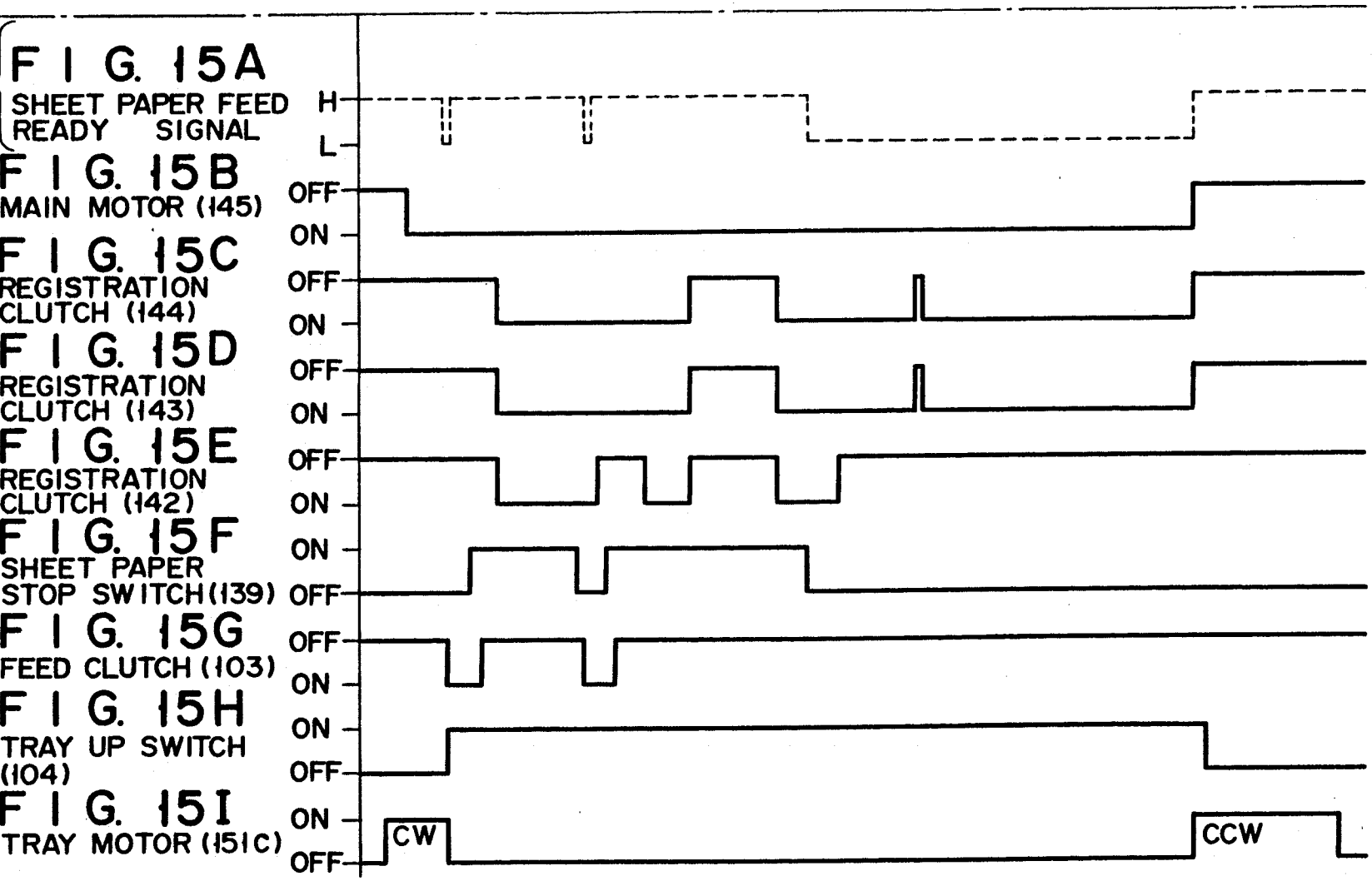
INTERNAL SIGNALS OF THE MULTI-CASSETTE FEEDER

PAPER SHEET FEEDER

BACKGROUND OF THE INVENTION

1. Field of the Invention

The present invention relates to a paper sheet feeder, and more particularly to a paper sheet feeder which can feed sheets of paper from any one of several paper cassettes as desired, to an image-forming unit incorporated in an image forming apparatus such as an electronic copying machine.

2. Description of the Related Art

Recently, a variety of image forming apparatuses have been put to practical use, each of which has an image forming unit and a paper sheet feeder. As disclosed in U.S. Pat. No. 4,639,125, the paper sheet feeder feeds sheets of paper, one by one, from a paper cassette to an image forming unit through a transfer path which comprises a plurality of rollers and guide plates. As disclosed in U.S. Pat. No. 4,605,215, the paper sheet feeder, however, has no means for adjusting the position of each sheet just taken from the cassette, but rather has registration rollers located in front of the image-forming unit. The registration rollers adjust the position of the sheet as immediately as the sheet is fed to the image-forming unit.

The conventional paper sheet feeder described above, designed for use in an image forming apparatus having a plurality of paper cassettes, has a long transfer path. As is known in the art, a paper sheet often has a skew or is set off the center immediately after it is fed from a paper cassette. Since the transfer path is relatively long, there is a great possibility that such a skew or such an offset increases as the sheet is fed through the path. In the worst case, the skew or setoff increases so much that the sheet can no longer registered at the image-forming unit. If the sheet having skew or set off the center undergoes image-forming process in the image-forming unit, the image formed on the sheet will be slanted one, or only part of the original image will be made.

SUMMARY OF THE INVENTION

It is therefore an object of the present invention to provide a paper paper feeder in which a paper sheet is positioned correctly right after it has been fed from a paper cassette, and neither has a skew nor is set off the center when it reaches an image-forming unit, and which therefore helps to ensure the forming of high-quality images.

According to an aspect of the present invention there is provided a paper sheet feeder comprising: first storing means for storing a first group of paper sheets;

second storing means for storing a second group of paper sheets;

first taking-up means for taking up the first paper sheets one by one from said first storing means;

first transferring means for transferring the first paper sheets supplied from said first storing means;

second taking-up means for taking up the paper sheets one by one for said second storing means;

second transferring means for transferring the second paper sheets to said first transferring means from said second storing means, said first transferring means transferring the second paper sheets transferred from said second transferring means;

selecting means for selecting one of said first and second taking-up means to energize the selected one of said first and second taking-up means; and means for causing one of said first and second transferring means which corresponds to the selected one of said first and second taking-up means to registering the corresponding paper sheet in a predetermined orientation.

According to another aspect of the invention, there is provided a paper sheet feeder comprising:

first storing means for storing sheet papers;

means for defining a transfer path in which the paper sheets are guided;

pick-up means for picking up the paper sheets one by one from said storing means;

registering means, located in the transfer path, for registering the paper sheet supplied from said pick-up means in a proper orientation and transferring the registered paper sheet in the transfer path; and common registering means, located upstream of said registering means in the transfer path, for registering the paper sheet supplied from said registering means in the proper orientation.

Either paper sheet feeder according to the invention can position a paper sheet correctly right after the sheet has been fed from a paper cassette, whereby the sheet neither has a skew nor is set off the center when it reaches an image-forming unit. The paper sheet feeder of either type can, therefore, serve to ensure the forming of high-quality images.

BRIEF DESCRIPTION OF THE DRAWINGS

FIG. 13A through 13I are a flow chart explaining how the paper sheet feeder shown in FIG. 2 feeds sheets of papers from any selected cassette to the image-forming unit; and FIGS. 14A to 14D and FIGS. 15A to 15I are a timing chart explaining when the components of the paper sheet feeder perform their functions.

DETAILED DESCRIPTION OF THE PREFERRED EMBODIMENTS

An embodiment of the present invention will now be described, with reference to the accompanying drawings.

Figure 1:
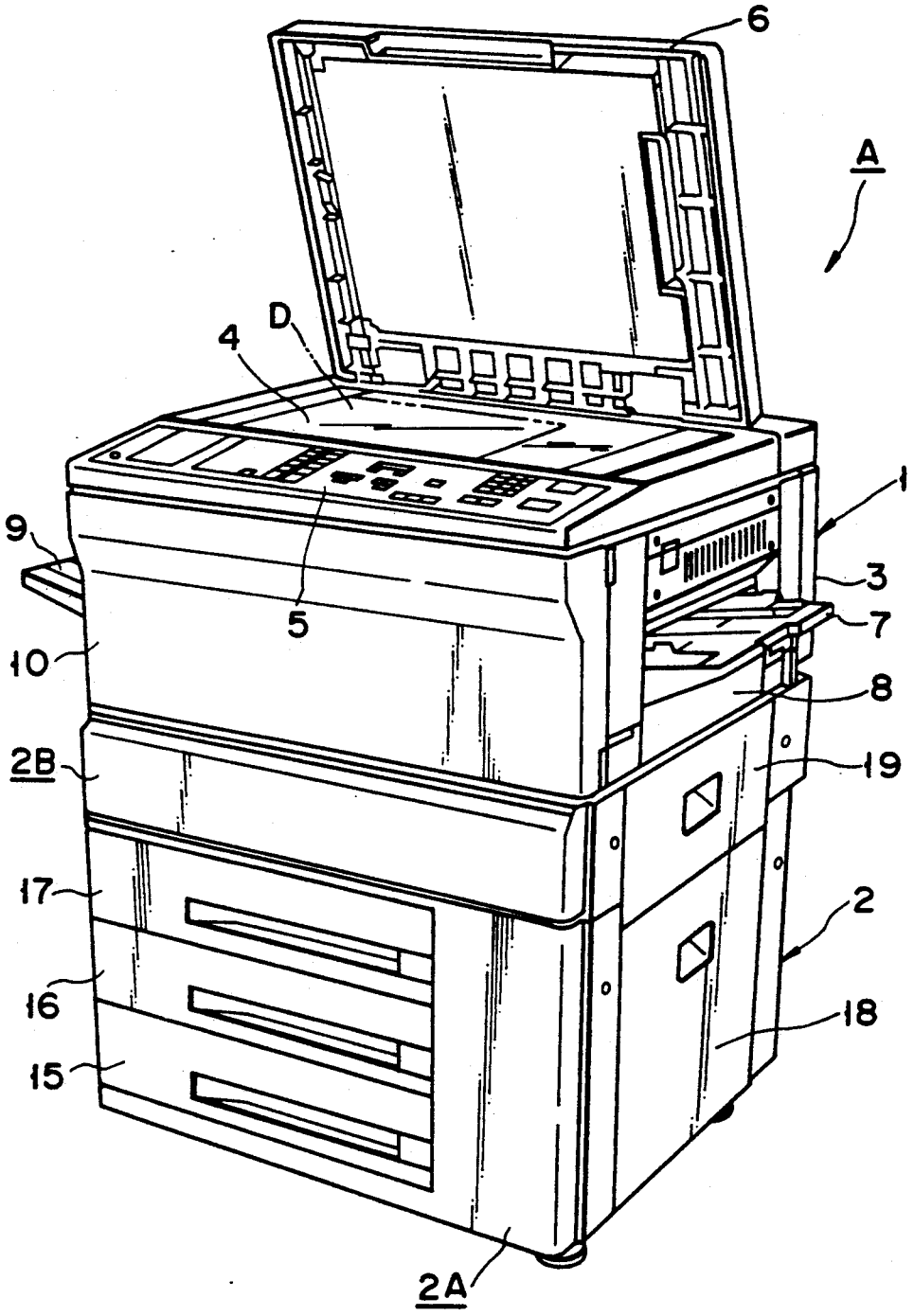
FIG. 1 is a perspective view showing an image forming apparatus comprising, among other components, a paper sheet feeder which is an embodiment of the present invention.
Figure 2:
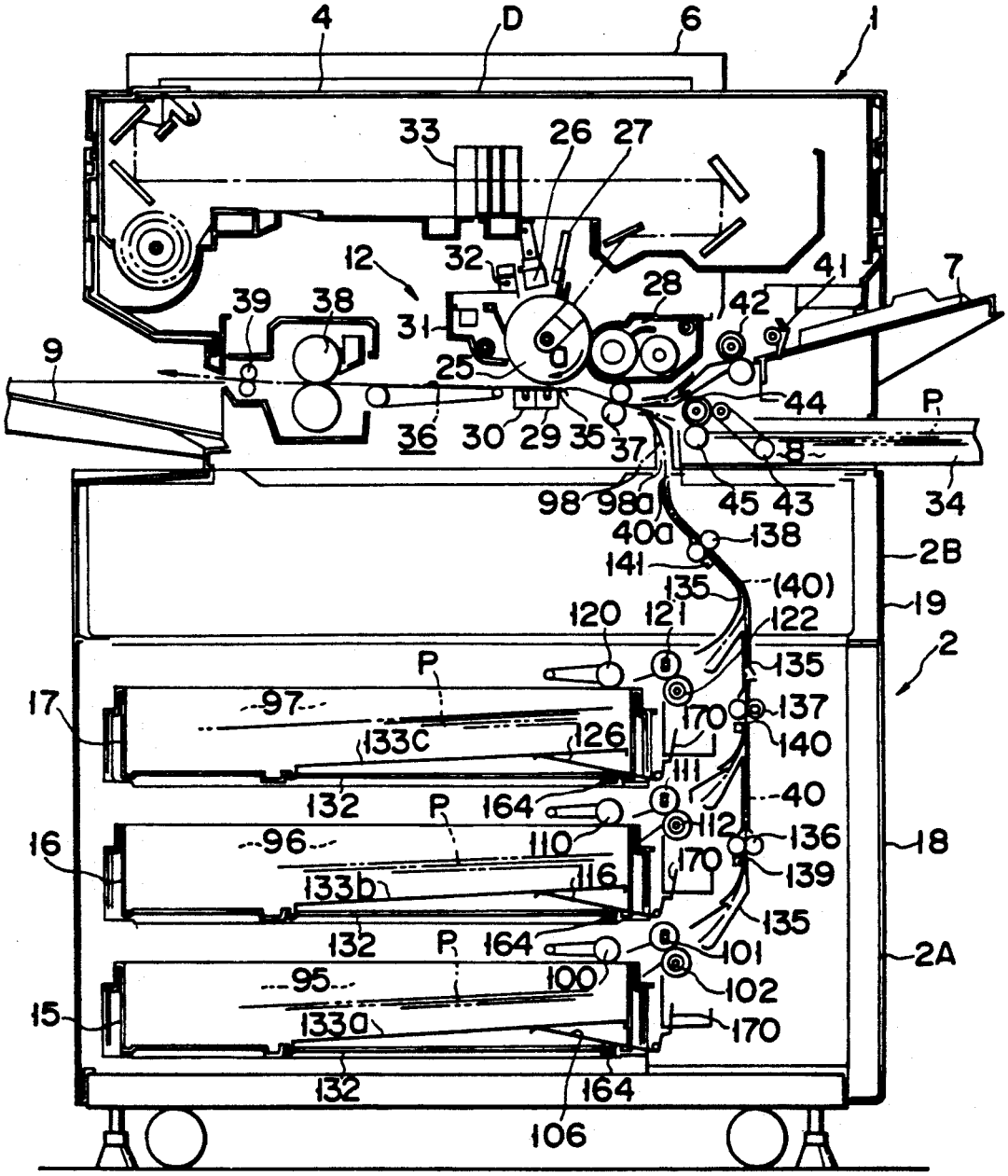
FIG. 2 is a cross-sectional front view showing the image forming apparatus of FIG. 1.

FIG. 1 shows the outer appearance of an image forming apparatus A having a paper sheet feeder according to the present invention. FIG. 2 illustrates the internal structure of the apparatus A.

As shown in FIG. 1, the apparatus A comprises an electronic photographic unit 1 and a sheet paper feeder 2 designed to feed paper sheets from two or more paper cassettes. The unit 1 is mounted on the paper sheet feeder 2.

The electronic photographic unit 1 comprises a box-shaped housing 3, a document-supporting glass plate 4, a control panel 5, a document-holding cover 6, a manual paper-feeding guide 7, a cassette holder 8, and a copy tray 9. The glass plate 4, used as a document table, is fixed at the top of the housing 3. The control panel 5 is secured on the top of the housing 3. The cover 6 is hinged to the rear-top portion of the housing 3. When the cover 6 is closed and, thus, placed upon a document put on the glass plate 4, it holds the document steadily. The guide 7 is secured to the right side of the housing 3. The cassette holder 8 is located in the lower part of the housing 3 and opens at the right side thereof. The copy tray 9 protrudes from the left side of the housing 3.

The paper sheet feeder 2 comprises an upper unit 2B and a lower unit 2A. The lower unit 2A has three paper cassettes 15, 16, and 17 which can be pulled sideways from the unit 2A. Two doors 18 and 19 are provided on the right side of the lower unit 2A. When either door is opened, a serviceman can access into the lower unit for maintenance purposes and, hence, can remove the paper cassettes 15, 16, and 17, whenever necessary.

As illustrated in FIG. 2, the electronic photographic unit 1 comprises a photosensitive drum 25 located substantially in the middle portion of the housing 3. The unit 1 further comprises a charger 26, an image-erasing LED array 27, a developer 28, an image transfer device 29, a paper separator 30, and cleaning device 31, a discharger 32—spaced apart from one another around the photosensitive drum 25.

The photosensitive drum 25 is rotatable. It has a photosensitive circumferential surface, on which an electrostatic latent image is formed when the light reflected from the document is applied. The carger 26 is designed to electrically charge the circumferential surface of the drum 25. The image-erasing LED array 27 is used to perform various image-editing processes, such as image-trimming and image-masking. The developer 28 is designed to apply a developer to the circumferential surface of the drum 25, thereby converting a latent image formed thereon into a visible image. The image transfer device 29 transfers a visible image from the drum to a paper sheet P. The paper separator 30 separates the paper sheet from the photosensitive drum 25. The cleaning device 31 removes the developer from the drum 25, thus cleaning the drum 25. The discharger 32 electrically discharges the photosensitive drum 25.

The electronic photographic unit 1 also has an exposure device 33. The device 33 is movable in the horizontal direction in the upper part of the housing 3. It applies the light reflected from the document D placed on the glass plate 4, onto the circumferential surface of the drum 25 through the gap between the LED array 27 and the developer 28.

A image transfer section 35 is provided between the photosensitive drum 25 and the image transfer device 29. Further, a paper transfer path 36 extends horizontally within the housing 3, for transferring sheets of paper, one after another, from the paper cassette 34 set in the cassette holder 8, form the paper sheet feeder 2, or from the manual feed guide 7, to the image transfer device 29, and hence to the copy tray 9.

A pair of registration rollers 37, an image fixing device 38, and a pair of sheet-ejecting rollers 39 are arranged along the paper transfer path 36. The registration rollers 37 are located upstream of the image transfer section 35, for correcting the position of each paper sheet to be fed to the section 35. The image fixing device 38 and he sheet-ejecting rollers 39 are located downstream of the image transfer section 35.

Figure 3:
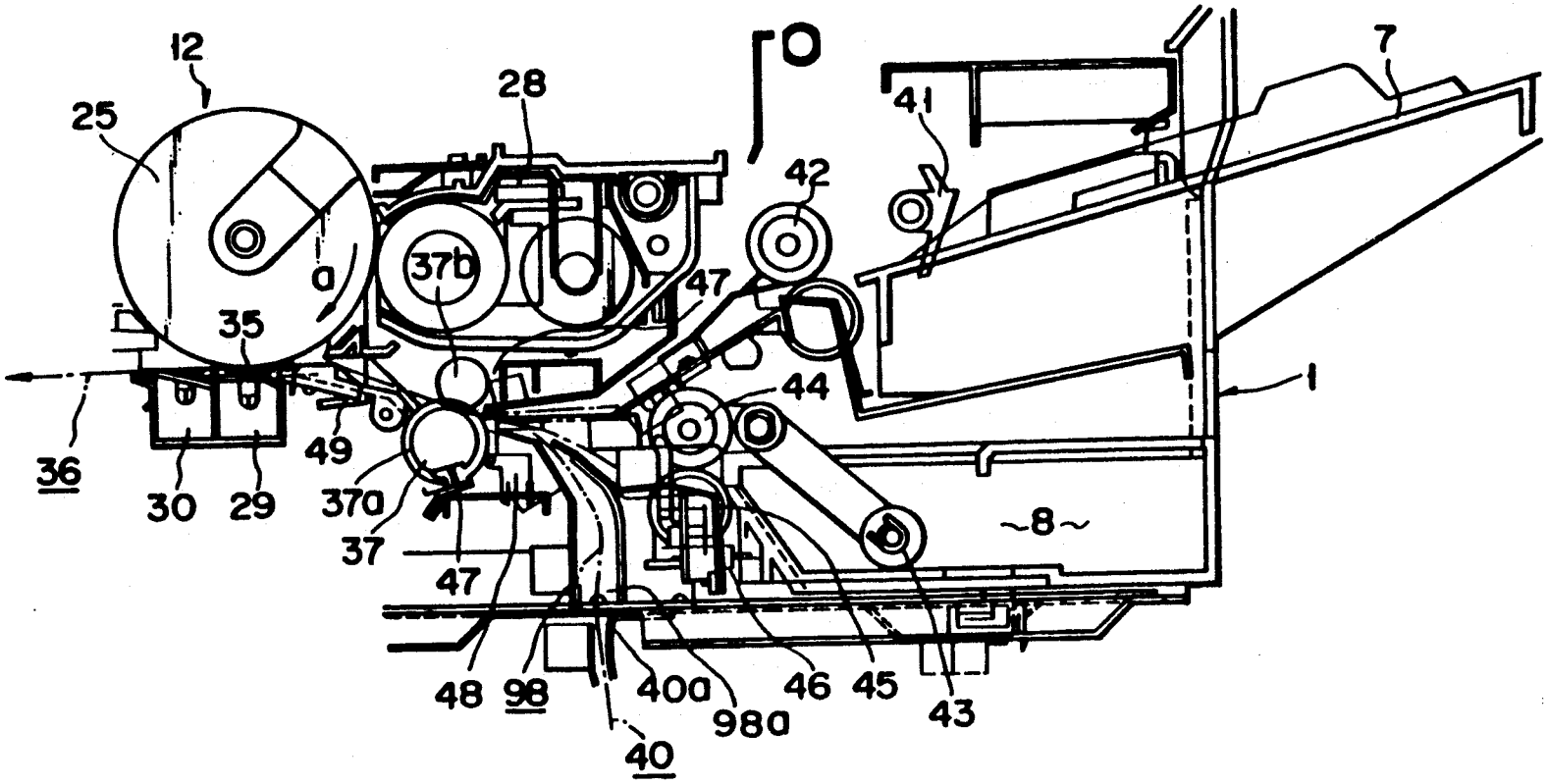
FIG. 3 is an enlarged, cross-sectional view of the upstream part of the sheet transfer path shown in FIG. 2.

As is shown in FIG. 3, a paper transfer path 40 extends substantially vertically, for transferring paper sheets P from the cassettes 15, 16 and 17. The path 40 is connected, at its downstream end, to that portion of the paper transfer path 36 which is immediately upstream of the registration rollers 37. A sheet detection switch 41 and a manual-feeding rollers 42 are located between the manual feed guide 7 and the registration rollers 37. Further, a pickup roller 43, a feed roller 44, a separator roller 45, and a size switch 46 are arranged between the cassette holder 8 and the registration rollers 37. The pickup rollers 43 are provided to take sheets P, one by one, from the paper cassette 34 held in the holder 8.

A brush 47 is set in frictional contact with the peripheral surface of the upper registration roller 37*a* and also with that of the upper registration roller 37*b*, for removing paper dust and chips from the peripheral surfaces of these rollers 37*a* and 37*b*. A paper-stopping switch 48 is located near the inlet of the registration rollers 37*a* and 37*b*, and a paper guide 49 is arranged at the outlet of the registration rollers 37*a* and 37*b*.

Figure 4:
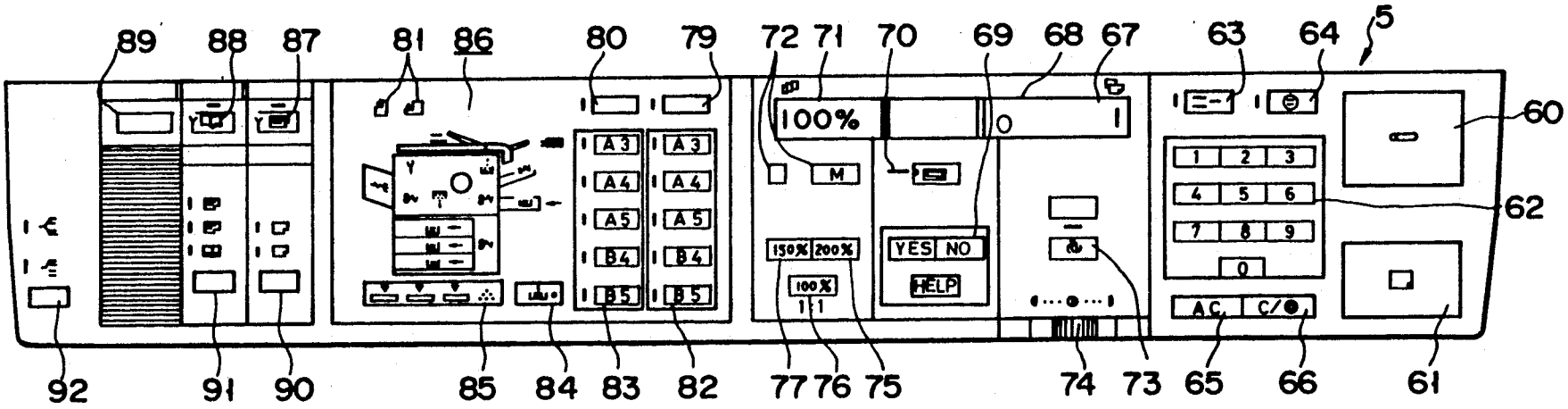
FIGS. 4 and 5 are a plan view of the control panel shown in FIG. 1 and an enlarged view showing a part thereof, respectively.

FIG. 4 shows the control panel 5 in detail. As is evident from this figure, a clip tray 60, a copy key 61, a ten-key pad 62, an interruption key 63, a preheating key 64, an all-clear key 65, a clear/stop key 66 are arranged on the right-end portion of the panel 5. The clip tray 60 is provided for containing clips or the like. When pushed, the copy key 61 outputs a signal for starting copying operation. The ten-key pad 62 has ten numeral keys, which are selectively operated to input the desired number of copies. Whenever pushed, the interruption key 63 outputs a signal for interrupting the copying operation. The preheating key 64 is depressed to drive a heater (not shown) to preheat some of the components of the image forming apparatus A. The all-clear key 65 is operated to change the operating mode of the apparatus from copy mode back to normal mode. The clear/-stop key 66 is pushed to change the desired number of copies, or stop the copying operation.

Two displays 67 and 68, an operation-guidance key 69, a color-copy counter 70, a magnification display 71, a memory set key 72, an exposure-mode key 73, a sliding knob 74, a first zoom key 75, a 100%-key 76, and second zoom key 77 are arranged on that portion of the panel 5 which is located slightly to the left from the center. The copy number display 67 is provided for displaying the desired number of copies, which has been input by operating the ten-key pad 62. The display 68 is used to display operation instructions or the operating mode in which the apparatus is set. When pushed, the operation-guidance key 69 outputs a signal that ultimately causes the display 68 to display the next operation that the user needs to perform. The color copy counter 70 counts the color copies which have been produced. The magnification display 71 displays a selected magnification at which to enlarge or reduce the original image. When operated, the memory set key 72 sets the copy mode reads one of copy modes for subsequent setting. The exposure-mode switch 73 is pushed to switching the exposure mode, from the automatic mode to the manual mode, and vice versa. The sliding knob 74 is moved to control the density in which to produce a copy of the original image. When operated, the first zoom key 75 increases the magnification at which to reproduce the original image. When pushed, the 100% key 76 changes the magnification to 100%. When operated, the second zoom key 77 decreases the magnification.

Figure 5:
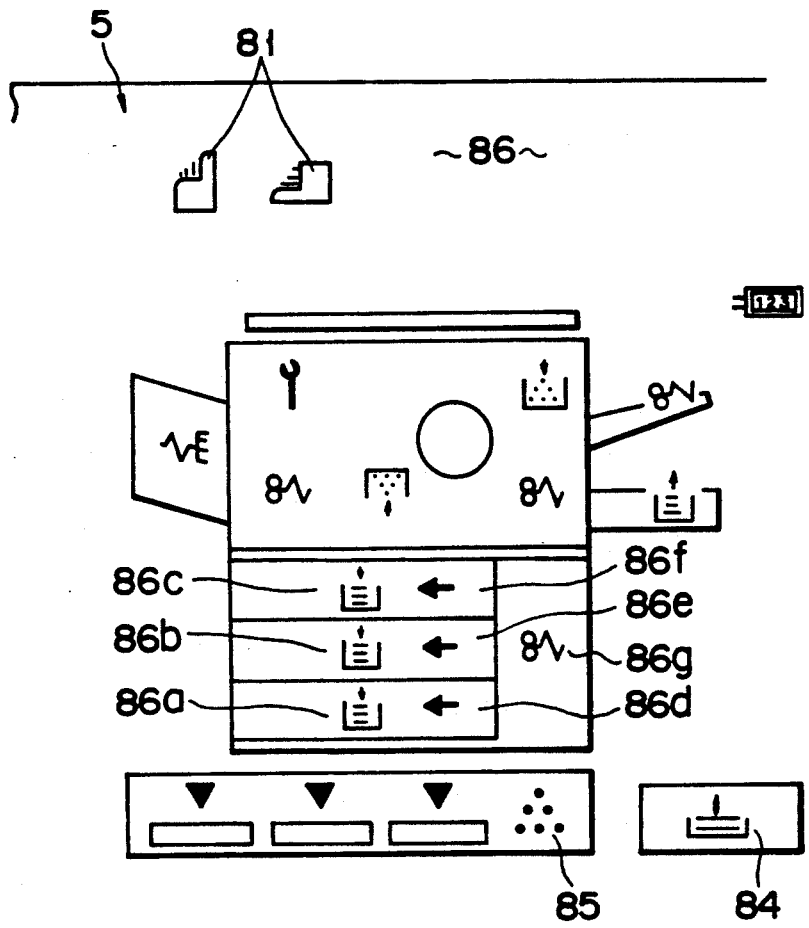

Further, an automatic paper selection mode key 79, an automatic magnification-selecting key 80, a document-orientation indicating lamp 81, a copy-size selecting key 82, a document-size designating key 83, a cassette-selecting key 84, a copy-color display 85, and a display panel 86 are arranged on that portion of the control panel 5 which is located slightly to the left from the middle portion thereof. The automatic sheet paper selection mode key 79 is pushed to set automatic sheet paper selection mode in the image forming apparatus. When depressed, the automatic magnification-selecting key 80 sets the automatic magnification-selecting mode in the apparatus. When operated, the document-orientation indicating lamp 81 indicates the orientation of the document D placed on the glass plate 4. The copy-size selecting key 82 is operated to select the size of copies to be made. The document-size designating key 83 is pushed to designate the size of the document D (i.e., the original) placed on the glass plate 4 and to select the magnification optimal to the size of the document, thus designated. When pushed, the cassette-selecting key 84 select from one of cassettes 15, 16, or 17. The copy-color display 85 indicates the color in which copies are to be produced. The display panel 86 automatically displays which operation the image forming apparatus is performing by displaying various blinking icons and non-blinking icons as is shown in FIG. 5. More specifically, when the paper cassette 15 is empty, the panel 86 displays a blinking icon **86*a* showing that no sheets of paper are left the cassette 15. When the paper cassette 16 is empty, the panel 86 displays a blinking icon 86*b* showing that there are no sheets of paper in the cassette 16. When the paper cassette 17 is empty, the panel 86 displays a blinking icon 86*c* indicate that paper cassette 17 contains no paper sheets. Moreover, the display panel 86 presents a non-blinking icon 86*d* when the cassette 15 is selected, a non-blinking icon 86*e* when the cassette 16 is selected, and a non-blinking icon 86*e* when the cassette 17 is selected. Also, the display panel 86 displays a blinking icon 86*g* when a paper jam occurs in the automatic paper sheet feeder 2**.

The control panel 5 further has a print-frame erasing key 87, a facing-page copying key 88, a total copy counter 89, a reproduced image editing key 90, a binding-margin selecting key 91, and a sorting/grouping key 92 are arranged on the left-end portion of the control panel 5. The print-frame erasing key 87 is depressed in order to reproduce only that portion of the original image which is outside a frame. The facing-page copying key 88 is pushed in order to copy two facing pages of a book at the same time. The total copy counter 89 counts the copies which the image forming apparatus A has produced since its installation, and indicates the number of copies produced. The reproduced image editing key 90 is operated to trim a reproduced image and/or mask the reproduced image. The binding-margin selecting key 91 is operated in order to prescribe a margin required for binding copied pages together. The sorting/grouping key 92 is depressed to designate sorting mode or grouping mode.

Now with reference to FIGS. 1 and 6, the paper sheet feeder 2 will be described in greater detail.

Figure 6:
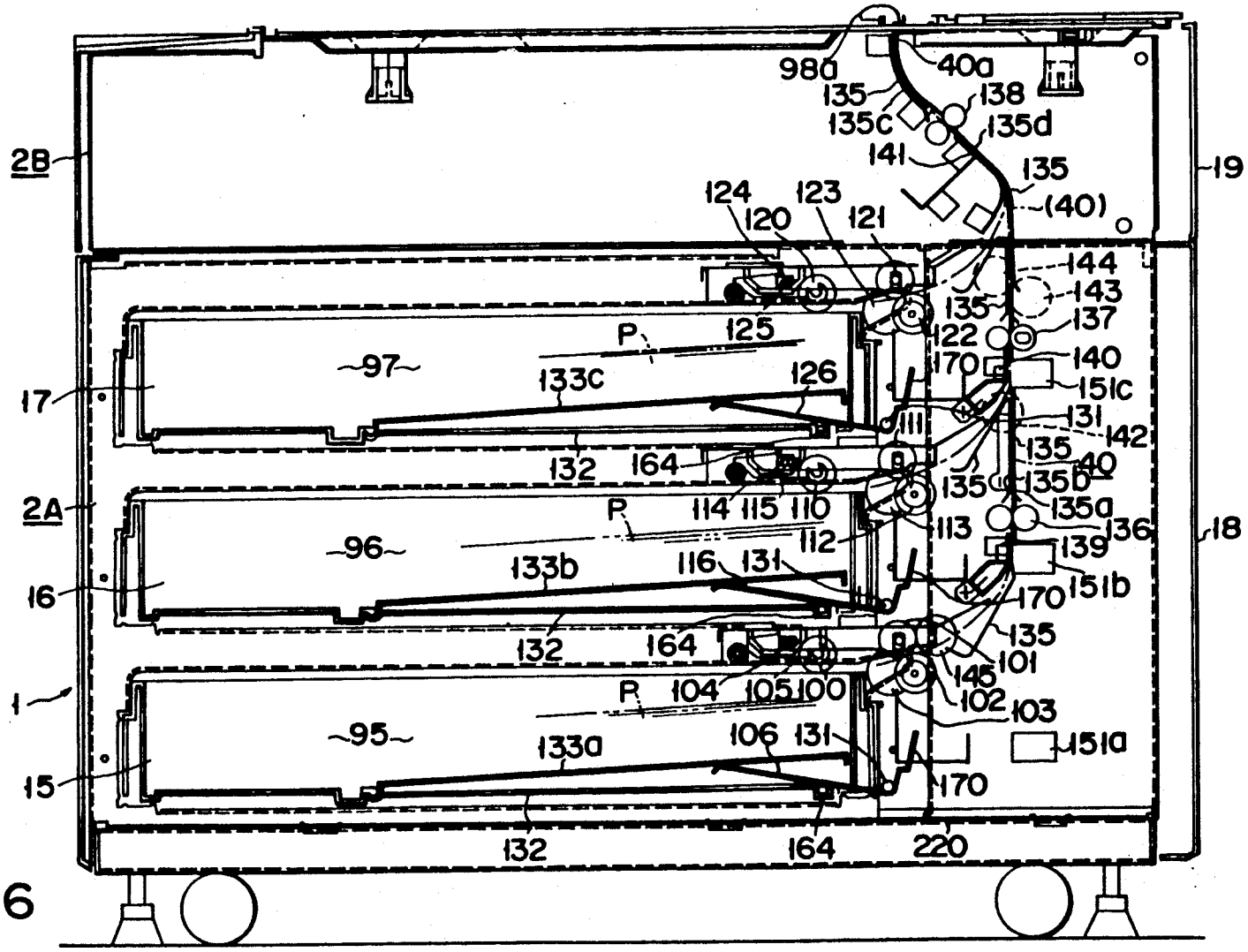
FIG. 6 is a cross-sectional front view showing the paper sheet feeder illustrated in FIG. 2.

As is illustrated in FIG. 6, the lower unit 2A of the feeder 2 contains three cassette holders 95, 96, and 97. These holders 95, 96 and 97 hold the paper cassettes 15, 16 and 17, respectively, such that each cassette can be pulled out from the front of the apparatus A. Thus, a stack of paper sheets can be placed in each cassette. Sheet papers P of A4-size are placed in, for example, the lower cassette 15. Paper sheets P of B4-size are placed in, for example, the middle cassette 16. Paper sheets P and A3-size are placed in the upper cassette 17. On the right side respectively within the lower unit 2A and the upper unit 2B, there is defined the transfer path 40 to upward deliver the sheet paper P, following the pickup from one of the paper cassettes 15, 16 and 17. The rear end **40*a* of the paper transfer path 40 is coupled to the front end 8*a* of a paper transfer path 98 defined upstream of the paper transfer path 36 defined within the electronic photographic unit 1 so that these sheet paper transfer lines will merge into one. There are further arranged a pickup roller 100 which is driven into touch with the top sheet paper in the lower cassette 15 to take it up, a feed roller 101 to feed forward the sheet paper, a sheet-separating roller 102 to separate sheet papers one from another when more than two sheet papers are picked up by accident, a feed clutch 103 to drive each of these rollers, a tray-up switch 104 to detect a tray moved up to its elevation point, an emptiness-detecting switch 105 to detect whether or not there exists a sheet paper, and an elevator 106. Likewise above, a pickup roller 110 which is driven into contact with the top sheet paper in the middle cassette 16 to take it up, a feed roller 111, a sheet-separating roller 112, a feed clutch 113, a tray-up switch 114 to detect a tray 133*b* moved up to its elevation point, an emptiness-detecting switch 115 to detect whether or not there exists a sheet paper, and an elevator 116 are provided. Furthermore, for the upper paper cassette 17, there are similarly provided a pickup roller 120, a feed roller 121, a sheet-separating roller 122, a feed clutch 123, a tray-up switch 124 to detect a tray 133*c* moved up to its elevation point, an emptiness-detecting switch 125 to detect whether or not there remains a sheet paper, and an elevator 126**.

Each of the elevators 106, 116, and 126 is rotated around an axis 131 by respective elevator drives **130*a*, 130*b*, and 130*c*, which will be described later. As each of these elevators undergoes a rotational displacement, a corresponding one of the trays 133*a*, 133*b*, and 133*c* which are each rotatably installed within the respective sheet paper cassettes 132*a*, 132*b*, and 132*c*, is pushed up through an opening provided in each of these cassettes 132*a*, 132*b*, and 132*c***, whereby the paper sheet P set on the tray is elevated up to a point where the paper is ready to be picked up.

Precisely with the paper transfer path 40, the transfer line is defined between a plurality of guide plates 135, and upstream of the paper transfer path 40, there is furnished a pair of registration rollers 136 not only to do postural adjustment of each sheet paper for registration, following the pickup from the lowermost paper cassette 15, but also deliver the paper over a certain distance along the paper transfer path 40. Further, at the midstream of the paper transfer path 40, there is also arranged a pair of registration rollers 137 not only to undertake postural adjustment of each sheet P for registration after the pickup from the middle cassette 16 but also deliver the paper for some distance along the transfer path 40, with another pair of registration rollers 138 likewise provided to make postural adjustment of the sheet paper for registration posterior to the pickup from the uppermost sheet paper cassette 17 and subsequently deliver the paper a given distance along the paper transfer path 40.

Besides, on the inlet side of the pair of registration rollers 136, a stop switch 139 is located to halt each paper sheet for subsequent alignment, which has been picked up from the lower paper cassette 15. Another stop switch 140 is provided to stop each paper sheet for alignment, which has been picked up from the middle paper cassette 16 on the inlet side of the pair of registration rollers 137. Still another stop switch 141 is provided on the inlet side of the registration rollers 138 to stop each paper sheet paper for alignment, which has been picked up from the upper cassette 17. The tray-up switches 104, 105, 114, 115, 124, and 125 are respective photo interrupters while the sheet paper stop switches 139 to 141 are respective reflection type photo sensors.

Further, three registration clutches 142, 143 and 144 are located in the vicinity of the midstream of the paper transfer path 4, where the registration rollers 137 are arranged. A main motor 145 is provided approximately upstream of the paper transfer path 40.

Figure 7:
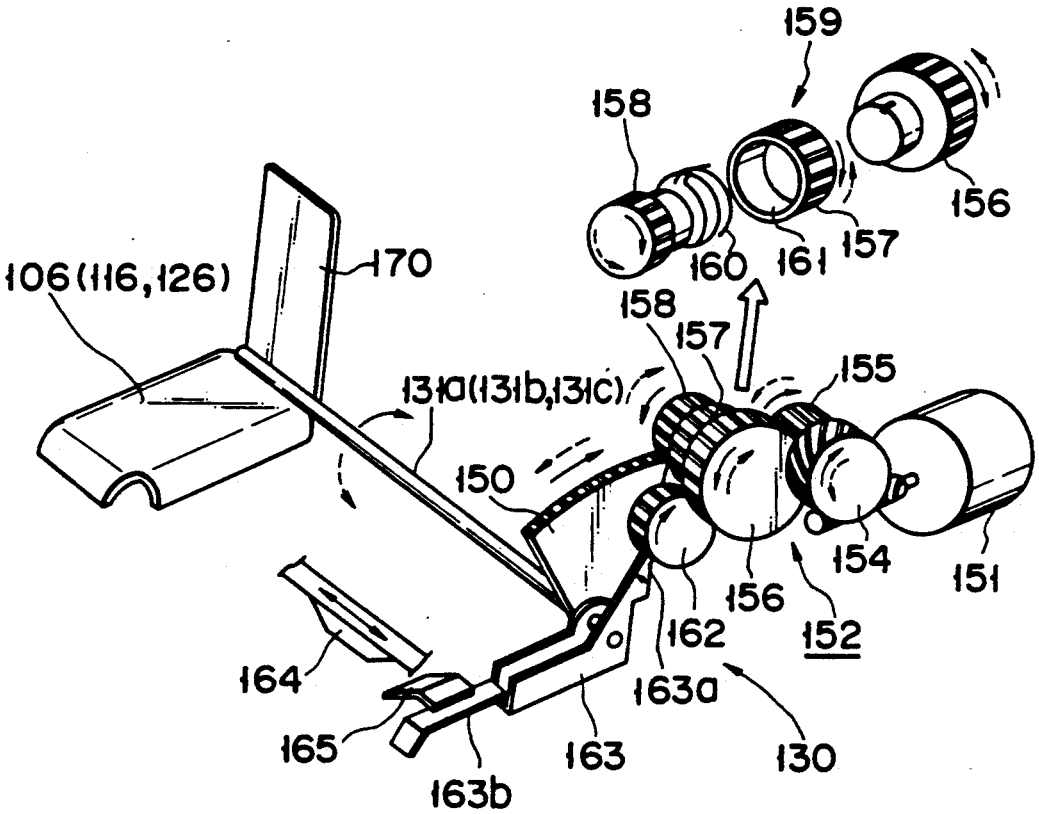
FIG. 7 is a perspective view schematically showing a part of the elevator drive mechanism illustrated in FIG. 6.
Figure 8:
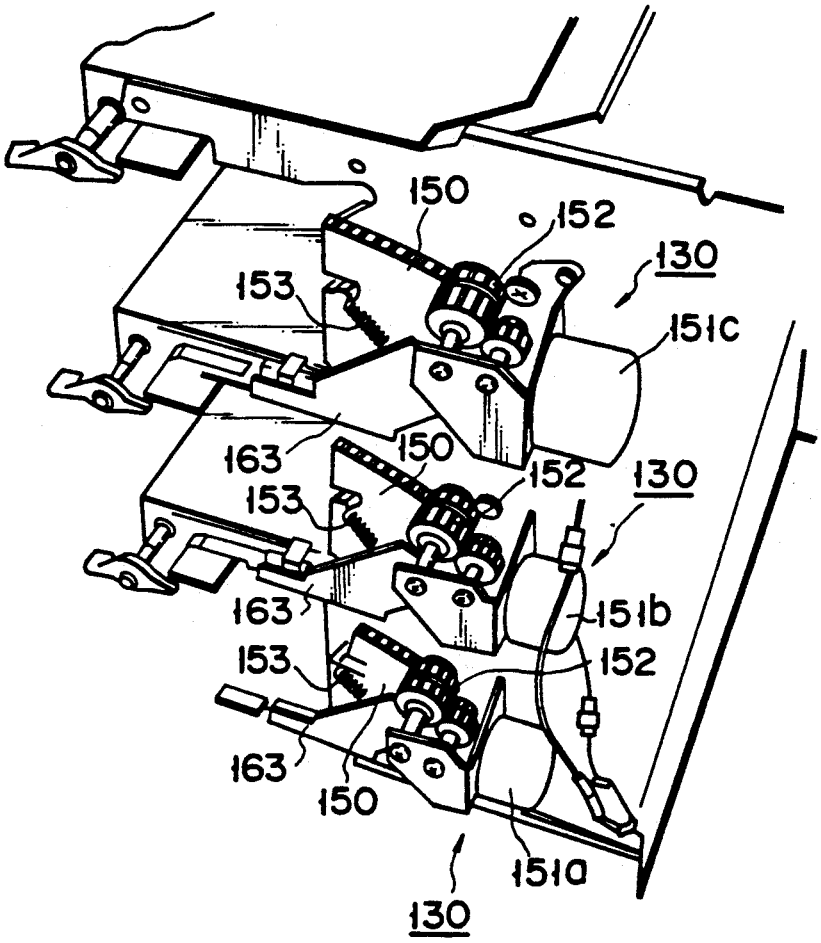
FIG. 8 is another perspective view showing the elevator drive mechanism presented in FIG. 6.

With reference to FIGS. 7 and 8, the elevator drives 130*a*, 130*b* and 130*c* will be described, which are designed to push up the trays 133*a*, 133*b*, and 133*c* provided for the paper cassettes 15, 16, and 17. Elevator drives 130*a*, 130*b*, and 130*c* are provided for paper cassettes 15, 16, and 17, respectively, and perform the same function. Therefore, only the elevator drive 133*a* for the lower paper cassette 15 will be described.

A toothed sector wheel 150 is mounted on a shaft 131 on which the elevator 106 is mounted to move the tray 133*a* upwards. A force is applied to the wheel 150 from a tray motor 151*a* to the sector wheel 150 by means of a gear train 152 and a spring-loaded clutch mechanism 159. As a result, the elevator 106 is rotated around the shaft 131 against the force of a spring 153 shown in FIG. 8. Namely, as shown in FIG. 7, the tray 133*a* is lifted up as the shaft of the tray motor 151*a* rotates in the direction of a solid-line arrow, that is, in forward direction. While the motor 151*a* is turned on, a worm wheel 154 keeps rotating in the direction of the solid-line arrow, whereby a gear 155 on the same shaft as the worm wheel 154 turns in the same direction. The rotation of the gear 155 is transmitted to a gear 156, which is thereby driven in the direction of the solid-line arrow. As the gear 156 rotates in this direction, a spring 160 of the spring-loaded clutch mechanism 159 is compressed gradually. The gears 157 and 158 are thereby driven in the same direction. The torque of these gears is transmitted to the toothed sector wheel 150 meshing with the gear 158. The wheel 150 is driven in the direction of the solid-line arrow direction, rotating the shaft 131 in the direction of the solid-line arrow. The elevator 106 undergoes a rotational displacement in the upward direction.

The gear 157 in mesh with the gears 156 and 158 has teeth formed in the periphery of a sleeve 161 of the spring-loaded clutch mechanism 159, and said sleeve in combination. The spring 160 is connected, at one end, to the gear 157. The gear 157 meshes with a gear 162.

As the shaft of the tray motor 151*a* rotates in the direction of the broken-line arrow, the tray 133*a* is moved downwards. The gear 155 mounted on the same shaft as the worm wheel 154 rotates in the same direction indicated by the broken-line arrow. The rotation of the gear 155 is transmitted to the gear 156. The ear 156 is thereby driven in the direction of the broken-line arrow, relaxing the spring 160 of the spring-loaded clutch mechanism 159. Hence, the gear 158 is brought back into free-rotating state. Once the gear 158 is brought into the free-rotating state, the sector wheel 150 is pulled by the spring 153 and driven in the direction of the broken-line arrow. The shaft 131 is therefore rotated in the direction of the broken-line arrow. As a result, the elevator 106 descends.

A lever 163 is rotatably mounted on the shaft 131. The lever 163 has, on its one end portion, gear teeth 163*a* which mesh with the gear 162. The lever 163 also has, and at its other end, a horizontal member 163*b*. A projection 164 protrudes from the lower surface front of each of the paper cassette 15, 16, and 17. A pusher 156 is rotatably connected by a shaft (not shown) to the upper face at the horizontal member 163*b*.

When any of paper cassettes 15, 16 or 17 is slightly pulled out, the projection 164 comes into contact with the pusher 16 and is rotated. The horizontal member 163*b* located at the opposite end of the elevator lever 16 is thereby pushed down and rotated around the shaft 131, in the direction of the solid-line arrow. As a result, the gear 162 rotates in the direction of the solid-line arrow. Hence, the gear 157, which is in mesh with the gear 162, rotates in the opposite direction. As the gear 157 rotates, the spring 160 of the spring-loaded clutch mechanism 159 is relaxed, whereby the gear 158 is brought into the free-rotating state. Then, the spring 153 pulls the sector wheel 150, rotating the wheel 150 in the direction of the broken-line arrow. As a result, the elevator 106 descends.

The elevator 106 moves from the cassette 15, and can be pulled out without abutting upon the elevator 106. (The elevators 116 and 126 move from the cassettes 16 and 17, respectively, and can be pulled out, in the same way as the elevator 106, without abutting on the cassettes 16 and 17). At the same time the tray 133*a* descends, the paper sheet P is separated from the pickup roller 100. Hence, the sheet P neither has a skew nor is set off the center. (Similarly, at the same time the trays 133*b* and 133*c* descend, the paper sheets P are separated from the pickup rollers 110 and 120, whereby the sheets P neither have a skew nor are set off the center.

As described above, the elevator 106 can be forced down the moment the paper cassette 15 is pulled out (The elevators 116 and 126 can be forced down the moment the cassettes 16 and 17 are pulled out.) Therefore, the force required to drive each elevator is less than in the conventional paper sheet feeder wherein one gear of the gear train forming a transmission mechanism for the elevator is disengaged when a lock release member is actuated by manipulating the handle of each sheet paper cassette. Hence, it is easy for the user to pull out the cassettes 15, 16 and 17. In addition, the cassette/elevator interlock drive prevents the gears from making noise as they engage and disengage from each other, and also serves to avoid excessive wear of the gears. Further, by virtue of the cassette/elevator interlock, only a relatively small number of support parts, each supporting a gear is required, and no complex part, such as cams, are required to release the support part. Therefore, the paper sheet feeder can be made compact and can be manufactured at low cost.

Figure 9:
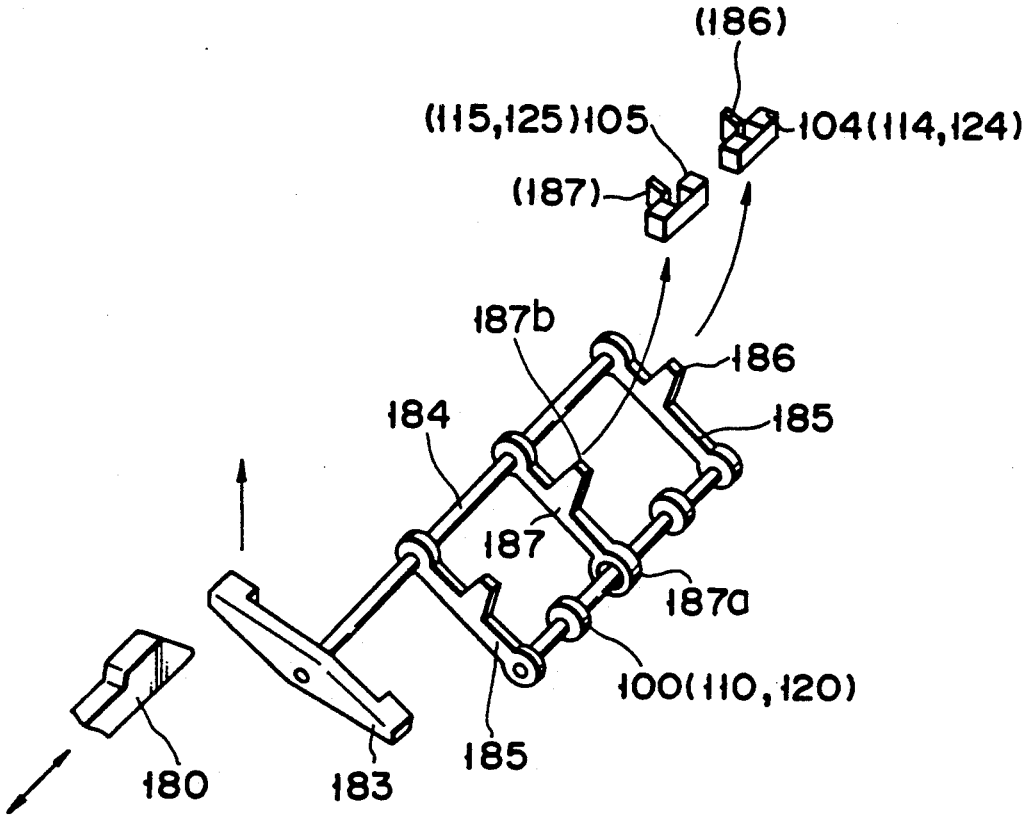
FIG. 9 is a perspective view of a mechanism incorporated in the paper sheet feeder, explaining how this mechanism operates to load a paper cassette into a predetermined position within the image forming apparatus shown in FIG. 6.

When the paper cassette 17 is loaded into the holder 97, a cassette latch 180 pushes up one end of a lever arm 183 as is shown in FIG. 9. As a result, a pickup roller 100 mounted on pickup arms 185, combined together by a shaft 184 and extending parallel, moves down to a predetermined position, along with these pickup arms 185. (Likewise, when the cassettes 16 and 15 are loaded into the holders 96 and 95, respectively, the cassette latch 180 pushes up one end of arm 183 as is shown in FIG. 9, whereby a pickup roller 100 moves down. However, the roller 100, like the pickup rollers 10 and 120, does not fall to a point where said pickup roller contacts the paper sheet P.

Further, when a cassette switch (not shown) detects the paper cassette 15 held in the holder, a tray motor 151*a* is turned on, whereby the cassette 15 pushes the tray 133*a* upwards. As a result, the uppermost sheet P in the tray 133*a* comes into contact with the pickup roller 100. The roller 100 is pushed upwards. When the tray-up switch detects an actuator 187 mounted on the pickup arm 185, the tray motor 151*a* is turned off, whereby the tray 133*a* stops moving upwards. Hence, it is determined the tray 133*a* has reached a paper feed position.

Likewise, when two other cassette switches (now shown) detect the paper cassettes 16 and 17 respectively, tray motors 151*b* and 151*c* are turned on, whereby the cassettes 16 and 17 push the trays 133*b* and 133*c* upwards. As a result, the uppermost sheet P in the tray 133*b* and the uppermost sheet P in the tray 133*c* come into contact with the pickup roller 110 and 120 respectively. The rollers 110 and 120 are pushed upwards. When the tray-up switches 114 and 124 detect actuators 187 mounted on the pickup arms 185, the tray motors 151*b* and 151*c* are turned off, whereby the trays 133*b* and 133*c* stop moving upwards. Hence, it is determined the trays 133*b* and 133*c* have reached a paper feed position.

Figure 10:
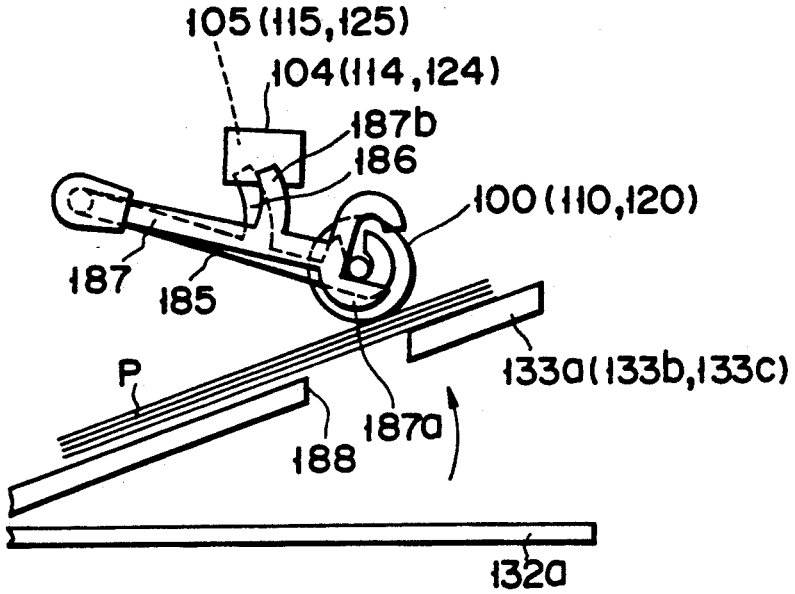
FIG. 10 and FIG. 11 are side views of the mechanism shown in FIG. 9, explaining how the mechanism detects the presence of a paper sheet and the absence thereof, respectively.

Further, when the paper sheet P is in the tray 133*a* (133*b* or 133*c*), a free end 187*a* of the actuator 187 stays on the sheet paper P as shown in FIG. 10, whereby a switch actuation member 187*b* is detected by the emptiness detection switch 105 (115 or 125). Hence, it is determined that the sheet P exists in said tray.

Figure 11:
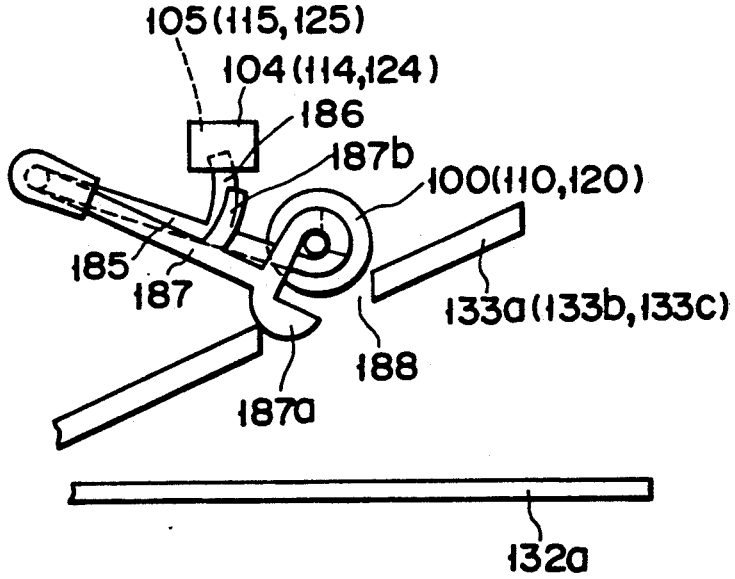

On the other hand, as shown in FIG. 11, when no sheets P exist in the tray 133*a* (133*b* or 133*c*), the free end 187*a* of the actuator 187 goes into an opening 188 made in the tray 133*a* (133*b* or 133*c*), whereby the switch actuation member 187*b* fails to get moved up to the position where said switch actuation piece member is detected by the emptiness-detecting switch 105 (115 or 125). Thus, it is determined that no sheets P are in said tray.

As is shown in FIG. 11, a base 132*a* is provided which corresponds to the bottom of the paper cassette 15 (16 or 17). If the copying operation is delayed more than two seconds after the tray 133*a* (133*b* or 133*c*) reaches the point of feed, this entails the lowering of the tray 133*a* (133*b* or 133*c*).

Figure 12:
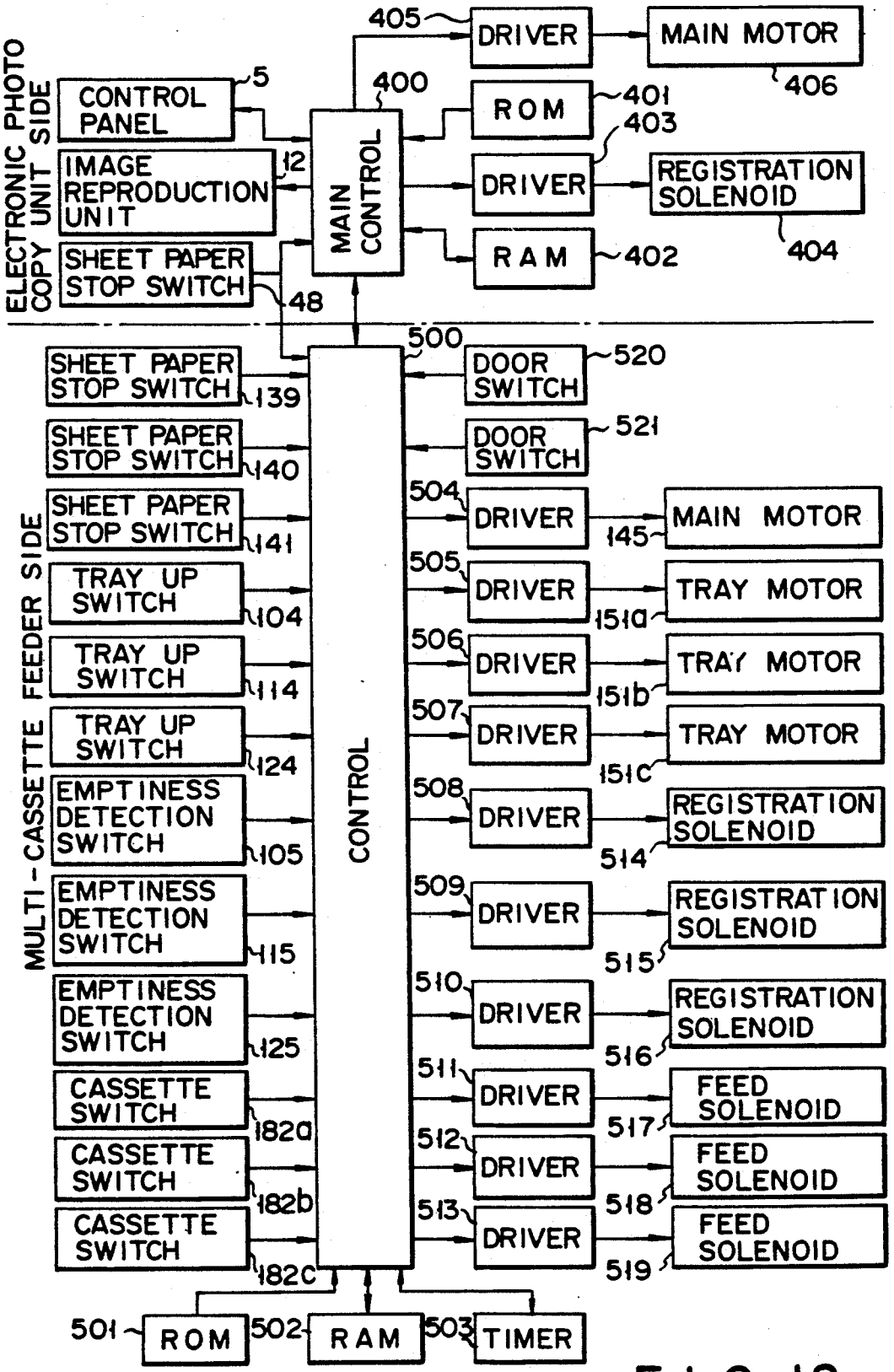
FIG. 12 is a block diagram showing the control circuit incorporated in the image forming apparatus shown in FIG. 1.

FIG. 12 is a block diagram showing the control circuit incorporated in an image forming apparatus A. As is illustrated in FIG. 12, a main control section 400 is provided in the electronic photographic unit 1, for controlling the other components of the unit 1, which are connected to the main control section 400. Among these other components are: the control panel 5, an image-forming unit 12 including the photo sensitive unit, etc.; the paper-stopping switch 48; a control program-loaded ROM 401; a RAM 402 of, for example, non-volatile type, for storing system run-related data; a driver 403 for energizing a registration solenoid 404; and a driver 405 of driving a main motor 406.

When driven by the driver 403, the registration solenoid 404 turns on the main motor 406, whereby the motor 406 rotates the registration rollers 37.

The RAM 402 is an S-RAM containing a lithium battery. The data loaded therein are safely maintained even the RAM 402 goes through power failure. The RAM 402 stores data items representing the sizes and orientations of the paper sheets contained in the cassettes 15, 16, and 17 which are held in the holders of the paper sheet 2. These data items are stored into the RAM 402 by a serviceman when the image forming apparatus is installed or adjusted.

It will now be explained how the serviceman stores the data items showing the sizes and orientations of paper sheets stored in the cassettes.

First, the servicemen pushes some of the numeral keys of the key pad 62, thereby setting the serviceman mode to the image forming apparatus. Then, he or she depresses the ten-key pad 62, thereby inputting the codes representing the size and orientation of paper sheets to be contained in the first paper cassette 15. Further, he or she operates the ten-key pad 62 likewise, thereby inputting the codes showing the size and orientation of paper sheets to be contained in the second paper cassette 16, and also the codes showing the size and orientation of the paper sheets to be contained in the third cassette 17. The main control section 400 writes the codes, thus input, into the RAM 402. Next, the serviceman moves paper guide members to specific positions along the respective paper transfer paths and holds them at these positions by screws, in accordance with the sizes and orientations of the paper sheets which the cassettes 15, 16, and 17 are to contain.

The image forming apparatus A further comprises a control section 500 for controlling the various components of the paper sheet feeder 2, which are connected to the section. Among these components are: a ROM 501 storing control programs; a RAM 502 for storing system data; a timer 503; the paper-stopping switches 48), 139, 140, and 141; the tray-up switches 104, 114, and 124; the emptiness-detecting switches 105, 115, and 125; the cassette switches 182*a*, 182*b*, and 182*c*; a door switch 520 for outputting a signal when the lower side-door 18 is opened and closed; a door switch 521 for outputting a signal when the upper side-door 19 is opened and closed; a driver 504 for driving the main motor 145; drivers 505, 506, and 507 for driving the tray motors 151*a*, 151*b*, and 152*c*; drivers 508, 509, and 510 for driving registration solenoids 514, 515, and 516; and drivers 511, 512 and 513 for driving sheet-feeding solenoids 517, 518, and 519.

The registration solenoids 514, 515 and 516 drive the registration clutches 142, 143 and 144 respectively. The sheet-feeding solenoids 517, 518 and 519 drive the sheet-feeding clutches 103, 113 and 123 respectively.

It will now be described how the paper sheet feeder 2 is set into standby condition when the power-supply switch of the electronic photographic unit 1 is turned on.

First, when the power to the electronic photographic unit 1, is turned on, the power is supplied to the paper sheet feeder 2. Then, the tray motors 151*a*, 151*b*, and 151*c* start rotating in forward direction, whereby the trays 133*a*, 133*b*, and 133*c*, provided for the cassettes 15, 16 and 17 begin to ascend. As a result, the tray-up switches 104, 114 and 124 are turned on. The tray motors 151*a*, 151*b* and 151*c* then start rotating in the reverse direction. The trays 133*a*, 133*b* and 133*c* thereby start descending. When the emptiness-detecting switches are on (H) each, it means that a paper sheet P exists on each tray. In this case, the trays 133*a*, 133*b* and 133*c* are held at their upper positions for 2 seconds. When there are made no copy commands during this 2-second period, the trays 133*a*, 133*b* and 133*c* are made to descend.

If the paper cassettes 15, 16 and 17 are not inserted in the paper sheet feeder 2 when the power-Osupply switch of the unit 1 is turned on, the corresponding tray motors 151*a*, 151*b* and 151*c* are not driven at all. When any one of the paper cassettes 15, 16 and 17 is inserted into the feeder 2, the corresponding tray is moved up, so that it is determined whether or not a sheet P exists on the tray.

When one of the sheet paper stop switches 139, 140 and 141 is on, that is, when a paper sheet P stays in the paper transfer path 38, it is determined that paper jam is occurring in the transfer path. In this case the paper sheet feeder 2 is inhibited from performing its function, until the jamming sheet P is removed from the sheet paper transfer path.

The paper sheet feeder 2 is brought into standby condition after it has been examined whether or not a sheet P exists on any tray by moving up or down the tray. While the feeder 2 remains in this condition, the trays 133*a*, 133*b* an 133*c* are set at their lower position. When any paper cassette is inserted into or pulled from the corresponding holder during the standby state, the corresponding tray 133*a*, 133*b* or 133*c* is moved up or down, thereby to determine whether or not a paper sheet P is present on the tray.

It will now be explained how the image forming apparatus A copes the original image formed on the document D.

When the operator pushes the copy key 61, the main control section 400 changes the level of a copy-run signal to the low level, and the driver 405 drives the main motor 406. When the copy-run signal falls to the low level, one of the tray motors 151*a*, 151*b* and 151*c* starts rotating in the forward direction. The corresponding one of the the trays 133*a*, 133*b* and 133*c* is thereby moved upwards. Upon lapse of 0.3 seconds after the level of the copy-run signal has fallen to the low level, the main motor 145 starts rotating.

As the tray 133*a*, 133*b* or 133*c* contacts the corresponding the tray-up switches 104, 114 or 124, the tray-up switch is turned on, whereby the tray is stopped. At this time, the control section section 500 lowers the level of a paper-feed ready signal to the low level, denoting that a sheet P can be immediately fed. This signal is supplied to the main control section 400. Upon receiving the paper-feed ready signal which is at the low level, the main control section 400 determines that the signal has been lowered to the low level, and outputs a paper-feed request signal. Thereafter, when the level of the power-feed ready signal increases to the high level, the section 400 determines that the paper-feed request signal has been accepted, and increases the level of the paper-feed request signal to the high level.

The paper sheet P is aligned by the pair of registration rollers 136, 137 or 148, and is further aligned by the pair of registration rollers 37. When a copy cycle is over, the main control section 400 changes the level of the copy-run signal to the high level. When the control section 500 of the feeder 2 determines, upon receipt of the copy-run signal from the main control 400, that the signal level has been changed to the high level, it stops the main motor 145. The tray motor 151*a*, 151*b* or 151*c*, whichever involved, is driven in the reverse direction. One of the trays 133*a*, 133*b* and 133*c* is thereby moved downwards.

It will be explained how paper jam is detected. When any sheet paper stop switch, the switch 139, 140 or 141 fails to start rotating within 1.6 seconds after the start of the paper feeding, or when the leading end portion of the sheet P fails to pass over the sheet paper-stopping switches 139, 140 and 141, it is determined that paper jam is occurring. When the lower side-door 18 of feeder 2 is closed while one of the paper-stopping switches 139, 140 and 141 is turned on, it is determined that the sheet P stays in the paper transfer path 38 and that paper jam is still undergoing. When paper jam occurs during the processing of making a plurality of copies, any sheet P fed to the electronic photographic unit 1 before the occurrence of this paper jam can undergo normal copying operation.

It will now be described how the image forming apparatus A automatically makes a service call, when the apparatus needs repair or adjustment which can by achieved by servicemen only. When one of the cassettes 15, 16 and 17 is inserted into or removed from the cassette holder, or when one of the tray-up switches 104, 114 and 124 is not turned on within 2 seconds after the corresponding tray 133*a*, 133*b* and 133*c* starts ascending at the start of copying operation, a service call is made automatically. To release the service call, the power-supply switch must be turned off. The service call cannot be released by opening or closing lower side-door 18 or the upper side-door 19.

Now, with reference to the flow charts of FIGS. 13A to 13G, and the timing charts of FIGS. 14A to 14D, and the timing charts of FIGS. 15A to 150I, it will be explained how the paper sheet feeder 2 feeds two paper sheets P continuously, one after another, from the paper cassette 15.

When the power-supply switch of the electronic photographic unit 1 is turned on, electric power is supplied to the paper sheet feeder 2. In the feeder 2, the control section 500 determines, in step ST1, whether or not a check mode has been set to the apparatus A. If YES, the section 500 performs the check-mode processing in step ST2.

If NO in step ST1, or if the operation pushes the "0" key and "9" key of the ten-key pad 62 at the same time in step ST3, the control section 500 determines, in step ST4, whether or not the check-mode processing is in progress, or whether or not the upper or lower sidedoor is opened, by checking door switches 520 and 521. In the case where either of these covers is found open, the section 500 turns off all motors and disengages the clutches involved in step ST6. Thereafter, when it is determined in step ST6, that the doors are closed are determined closed from the conditions of the door switches 520 and 521, or when it is determined in step ST4 that the doors are closed, the control section 500 determines in step ST7 whether any paper-stopping switch 139, 140 or 141 is on or not. If YES in step ST7, the section 500 determines that paper jam is occurring and starts taking measures against the paper jam, as will be described later.

If NO in step ST7, the control section 500 causes the trays 133*a*, 133*b* and 133*c* to move upward, in step ST8. More specifically, the section 500 actuates the drivers 504, 505 and 506, whereby the tray motors 151*a*, 151*b* and 151*c* are driven in the forward direction. The motors 151*a*, 151*b* and 151*c* drive the elevators 106, 116 and 126 lift the trays 133*a*, 133*b* an 133*c* respectively.

Figure 13A:
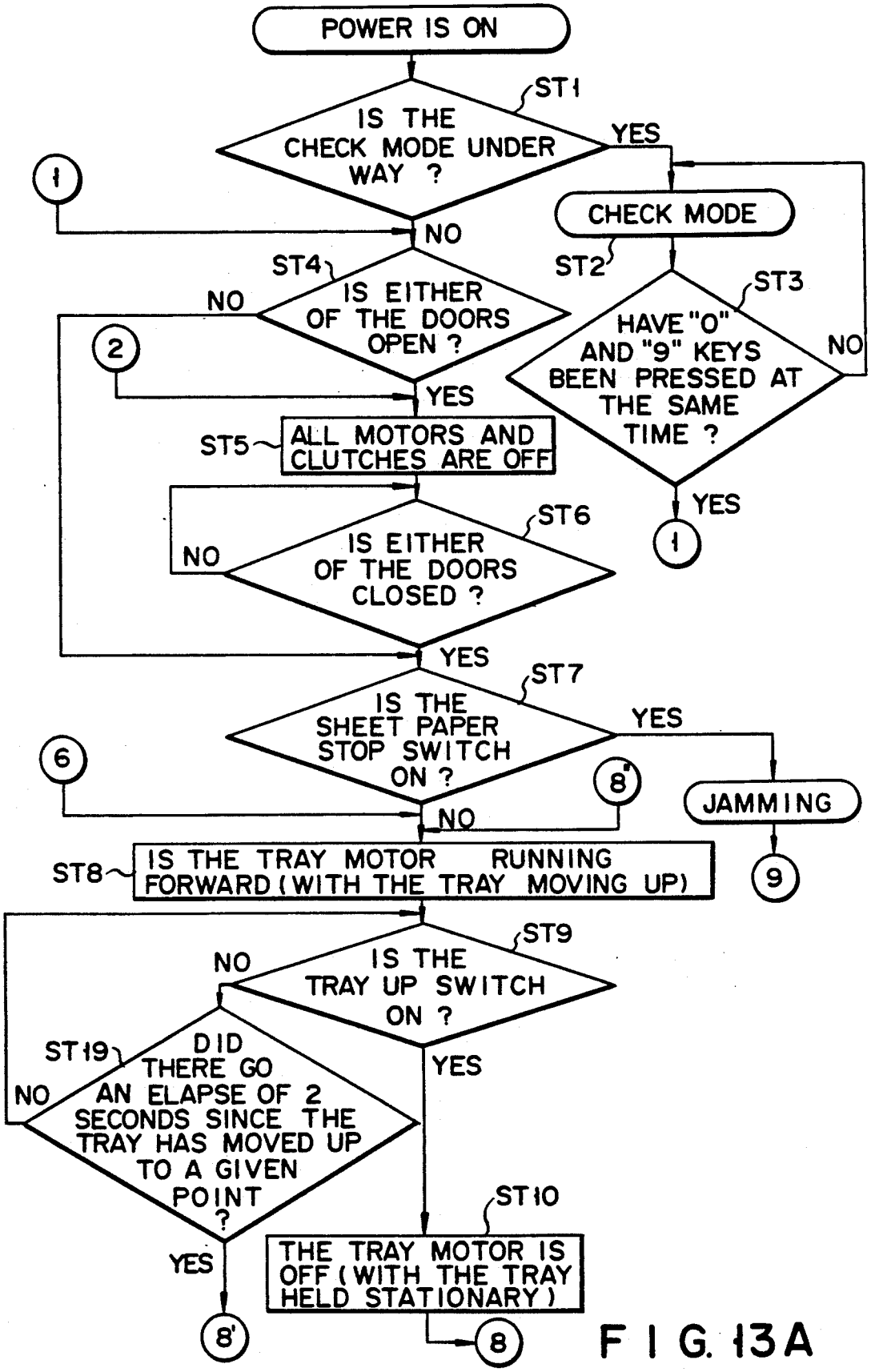
Figure 13B:
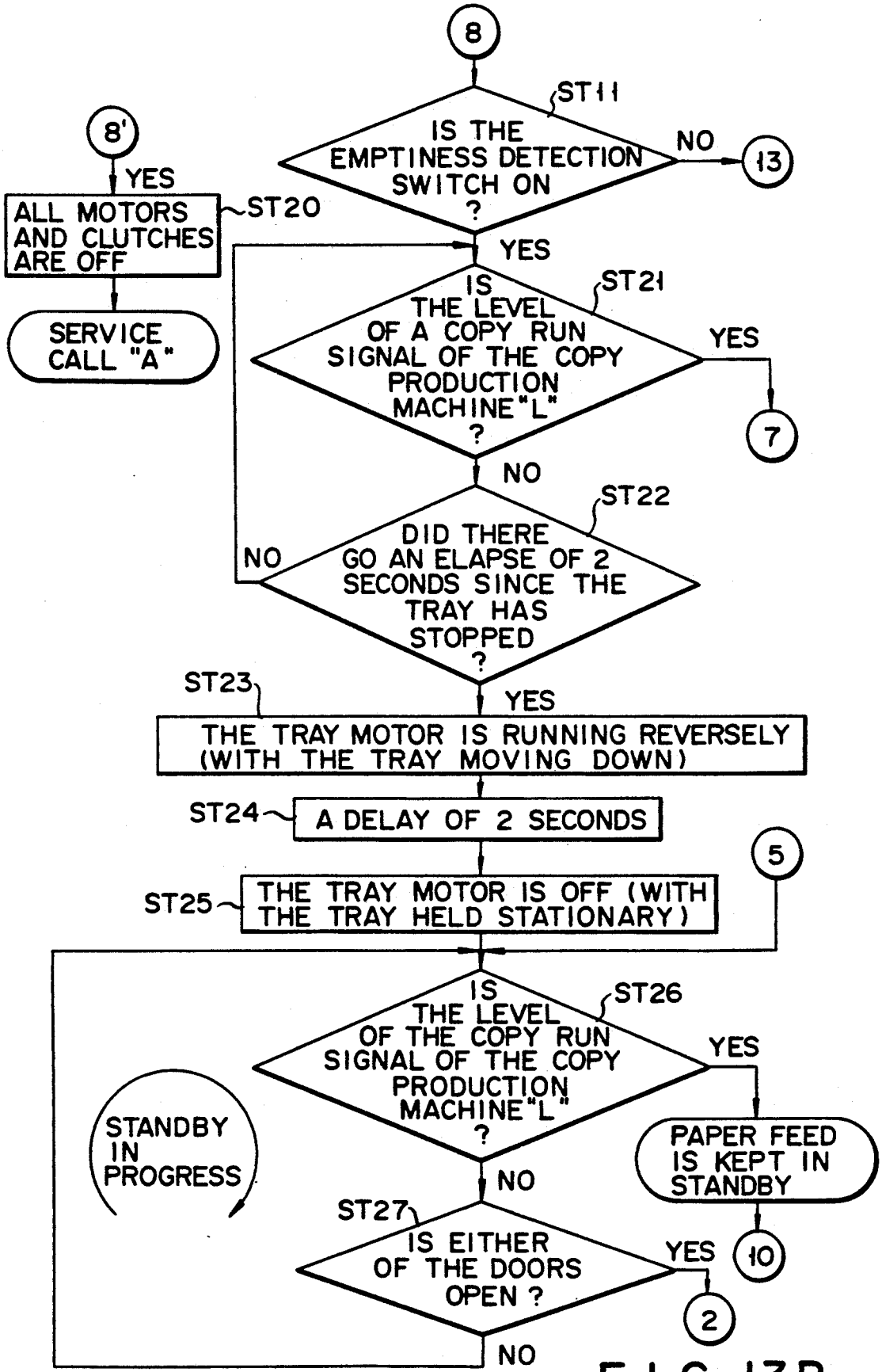
Figure 13C:
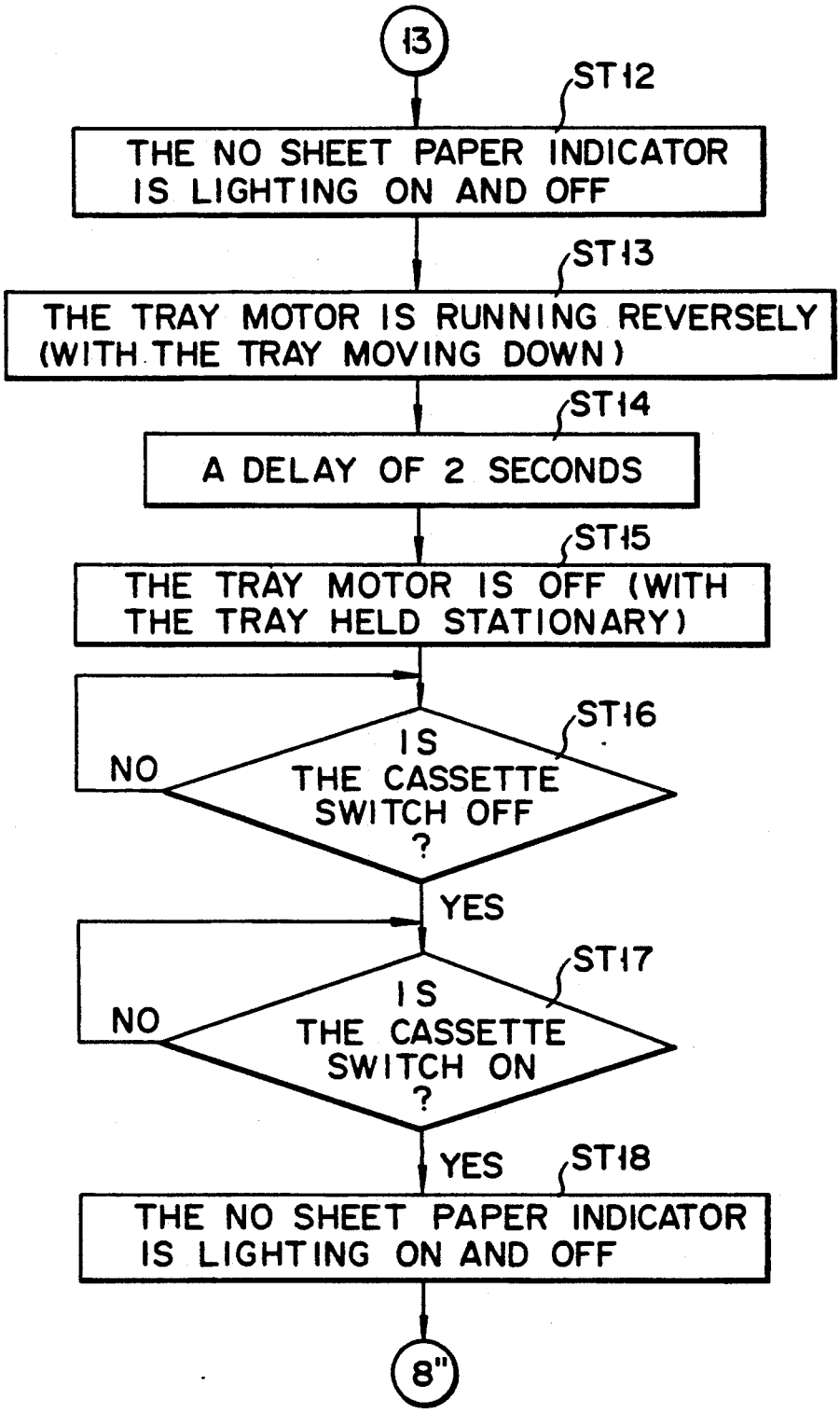
Figure 13D:
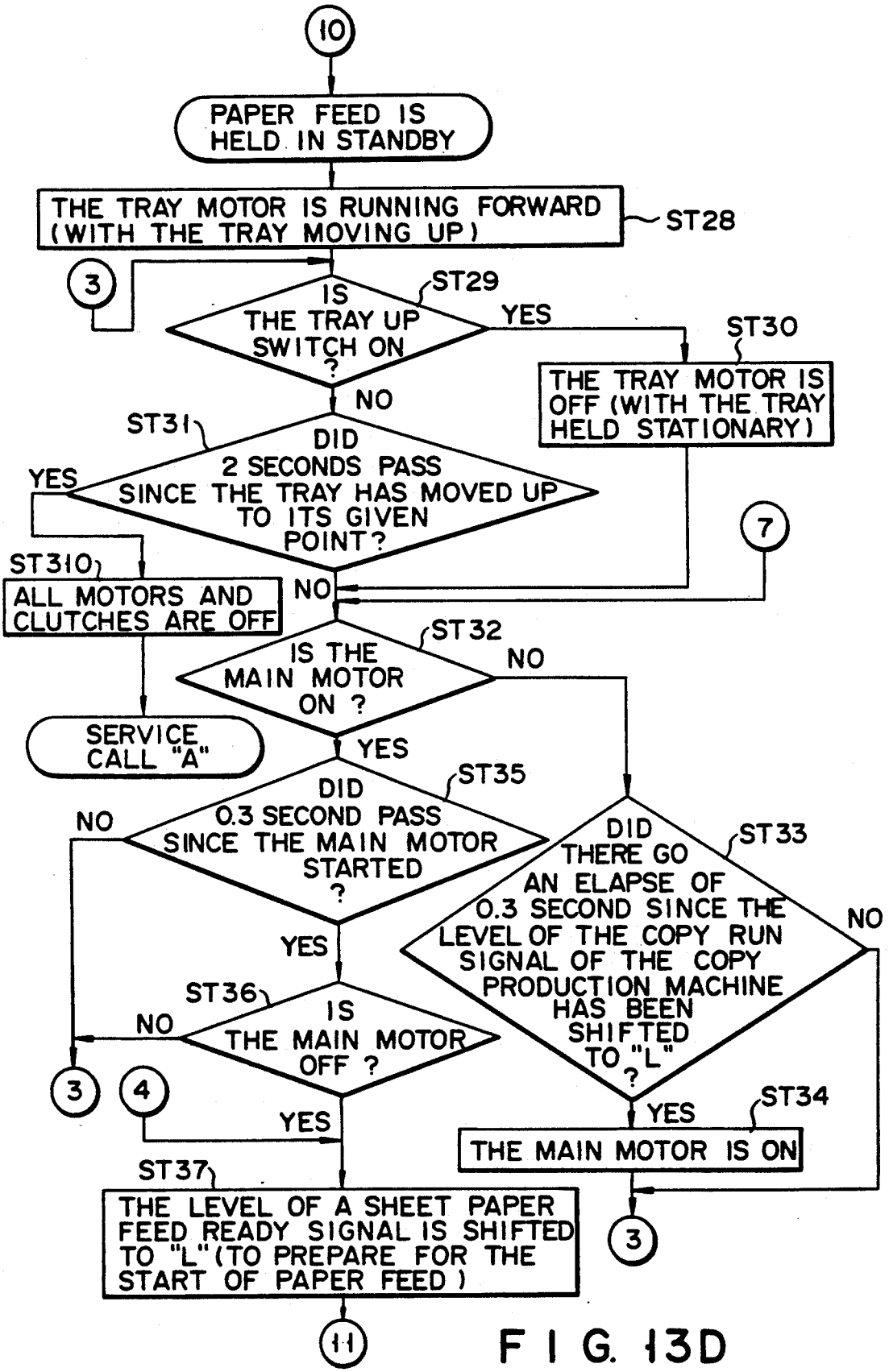
Figure 13E:
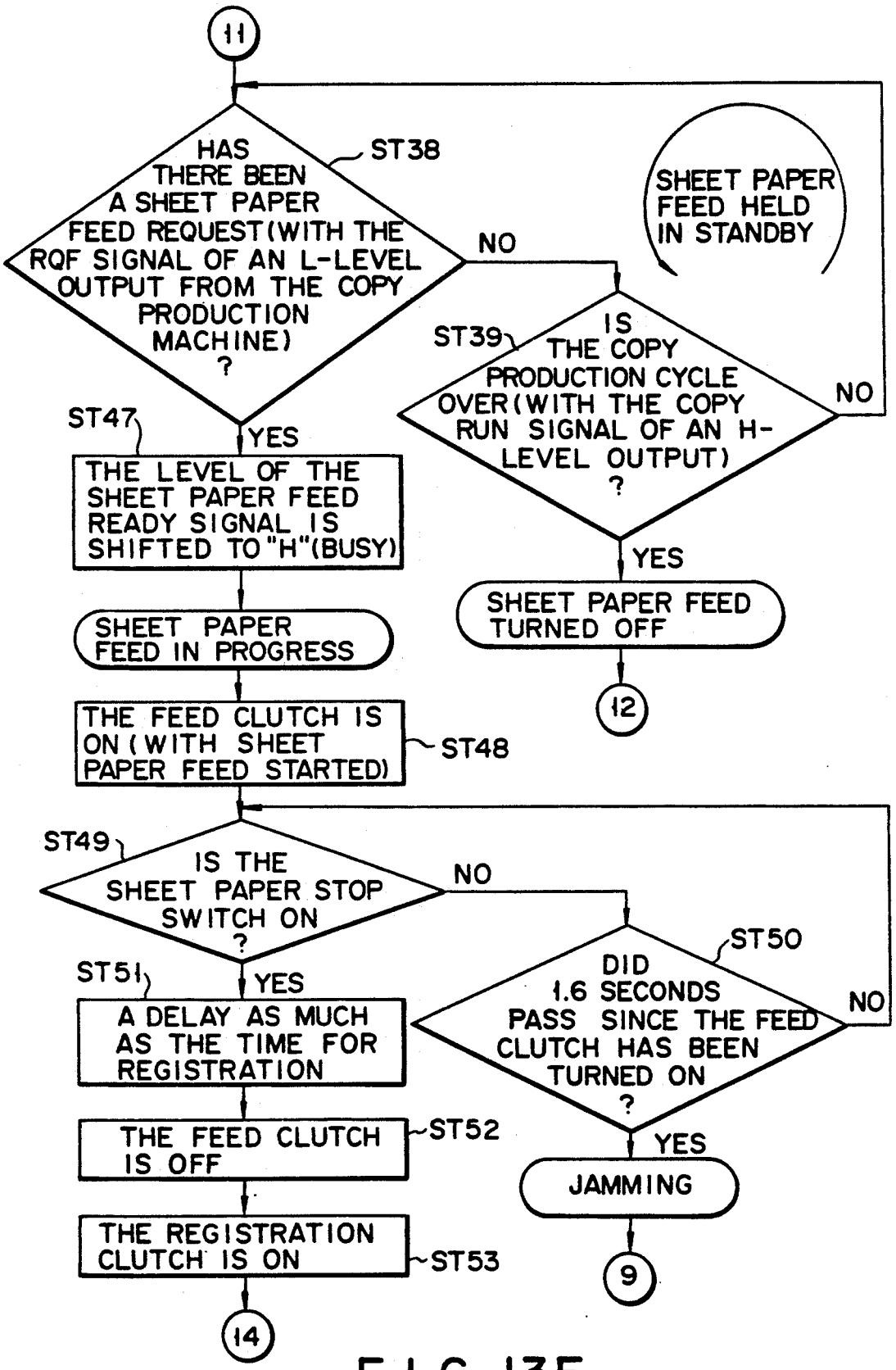
Figure 13F:
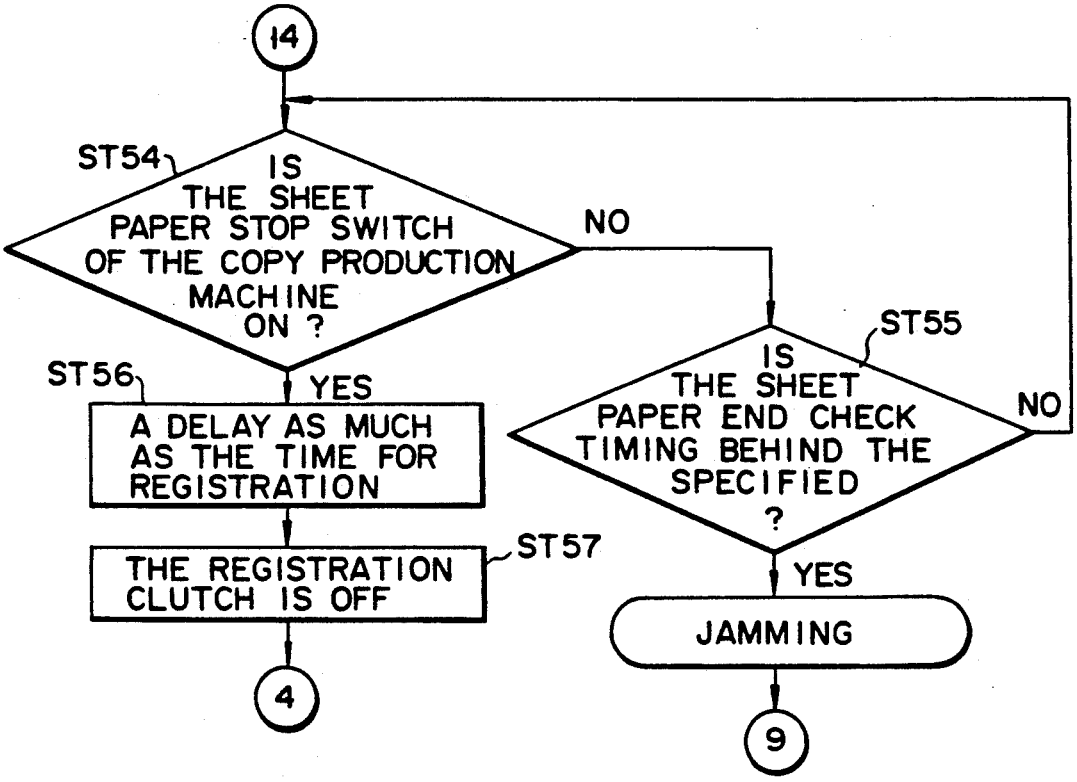
Figure 13G:
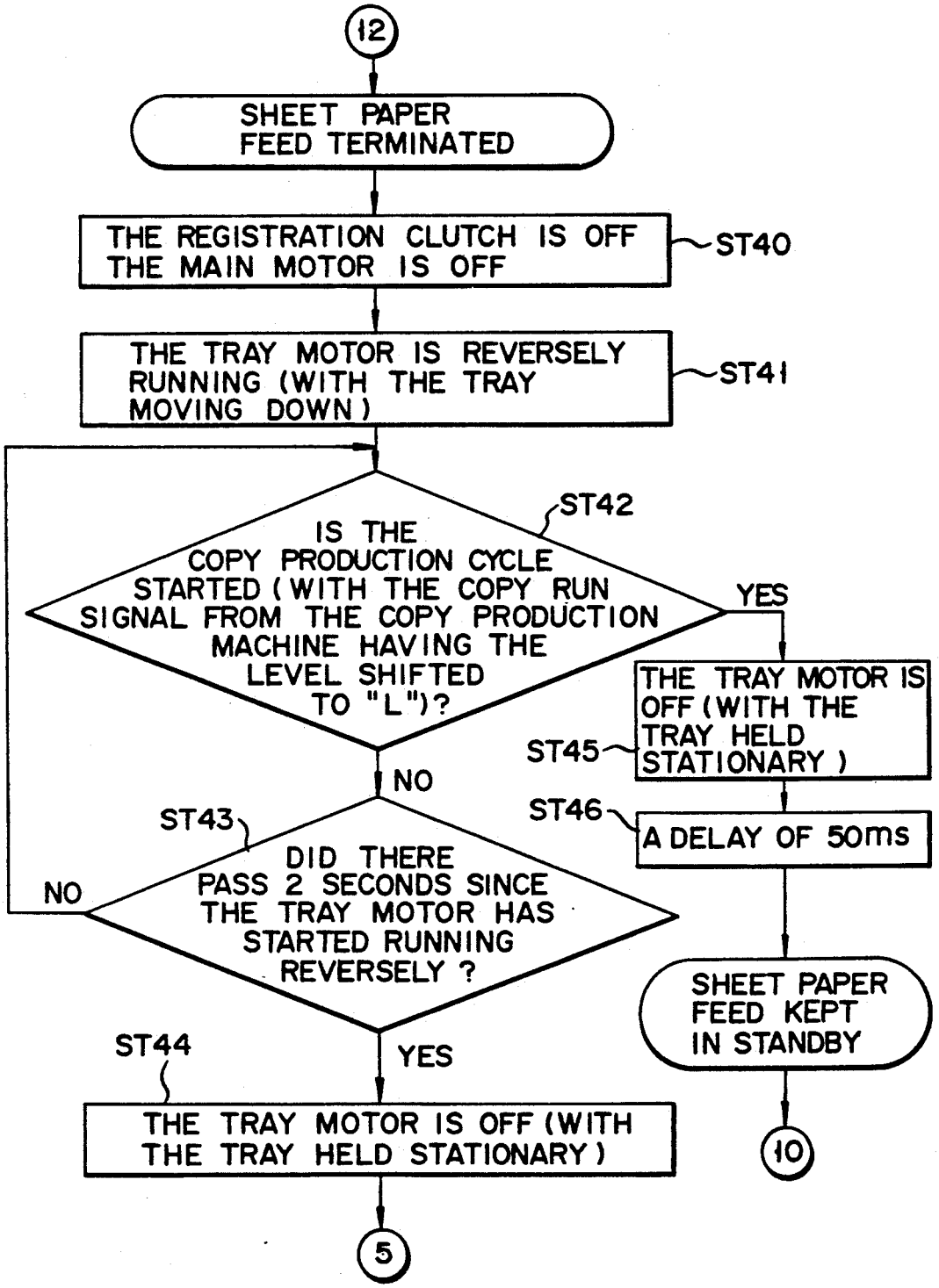
Figure 13H:
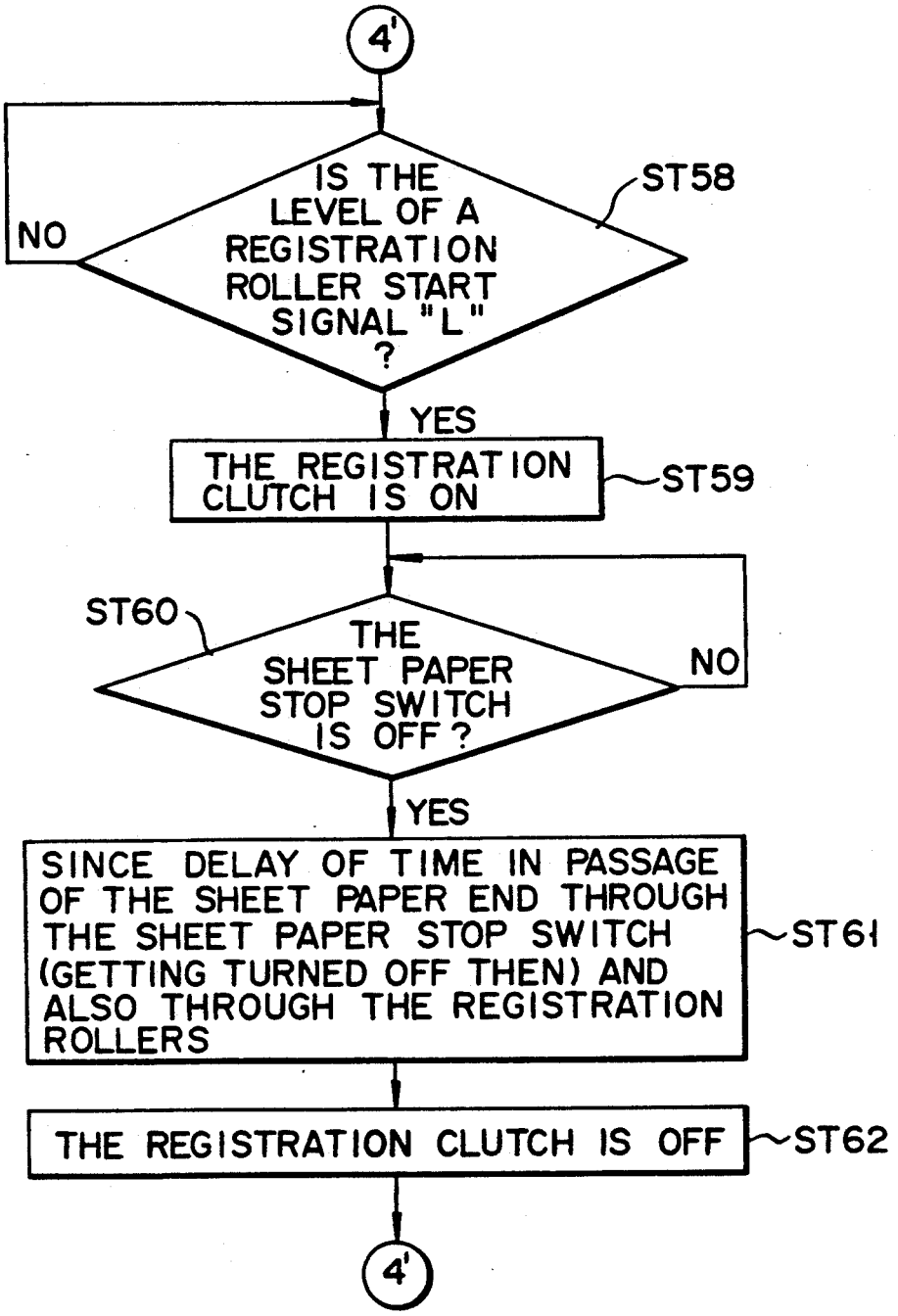
Figure 131:
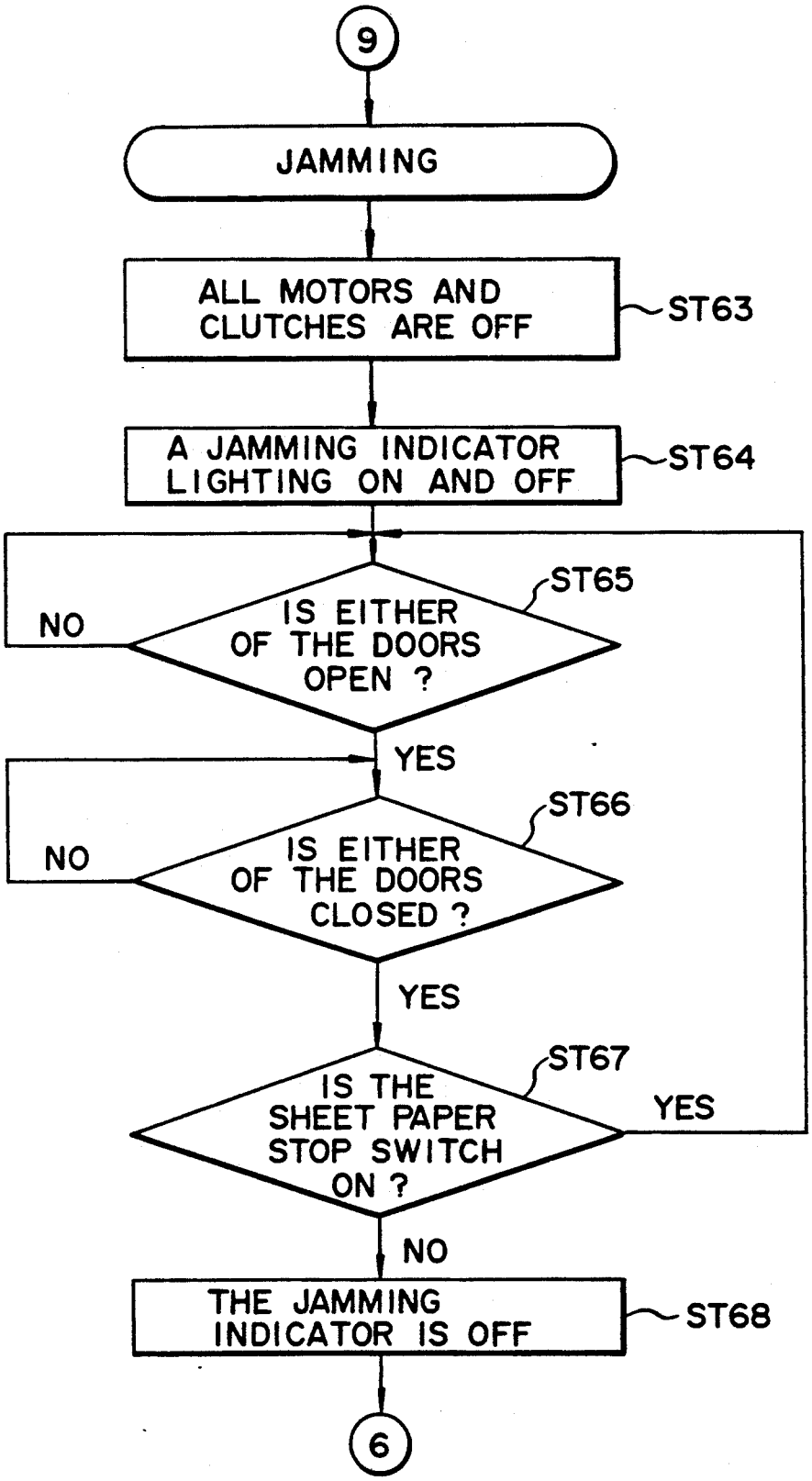

Thereafter, the control section 500 determines, in step ST9, whether the tray-up switches 104, 144, and 124 are on or not, as is shown in FIG. 13A. If YES, the section 500 stops the tray motors 151*a*, 151*b* and 151*c*, thereby stopping the trays 133*a*, 133*b* and 133*c* in step ST10. When the trays 133*a*, 133*b* and 133*c* are thus stopped, the section 500 determines, in step ST11, whether any emptiness switches 105, 115 or 125 is on or not. If NO in step ST11, the section 500 outputs a signal representing there are no paper sheets P in any paper cassette. This signal is supplied to the main control section 400.

In the case where the emptiness switch 105 is not on, the main control section 400 causes the display 68 to display a message "REPLENISH PAPER SHEETS", and displays the blinking icon 86*a* showing that no sheets of paper are left the cassette 15, in step ST12. Subsequently, in step ST13, the control section 500 outputs a signal instructing that the tray 133*a* be lowered. More precisely, the section 500 actuates the driver 504, whereby the tray motor 151*a* rotates in the reverse direction. The motor 151*a* lowers the elevator 106 for the base 132*a*, and the tray 133*a* is moved downwards. Upon lapse of 2 seconds after the tray 133*a* starts moving down, the control section 500 de-energizes the driver 504 in step ST14, thereby stopping the tray motor 151*a*. As a result, the tray 133*a* is stopped in step ST15. Further, in step ST16, the section 500 determines that the cassette switch 182*a* is off, and that the paper cassette 15 has been pulled out of the cassette holder. When the the control section 500 determines in step ST17 that the cassette switch 182*a* is on and that the cassette 15 has been inserted into the holder again, the section 500 outputs signal instructing that a lamp be turned off a lamp indicating that that the cassette 15 contains no sheet papers. This signal is supplied to the main control section 400. In response to this signal, the main control section 400 turns off the lamp in step ST18, erasing the icon 86*a*. Then, the operation returns to step ST8.

Even if neither the emptiness-detecting switch 115 nor the emptiness-detecting switch 125 is turned on, and hence the control section 500 determines that there are not paper sheets P in the cassette 16 or the cassette 17, the same sequence of steps is performed as in the case of where the emptiness-detecting switch 105 is turned off and the section 500 therefore determines that no sheets P are in the cassette 15. Thus, the icon 86*b* is displayed when the cassette 16 contains no sheets P, and the icon 86*c* is displayed when the cassette 17 contains no sheets P.

If it is determined in step ST19 that any one of the tray-up switches 104, 114, and 124 fails to turns on within 2 seconds after the trays 133*a*, 133*b* and 133*c* have moved upwards, the control section 500 outputs a signal indicating trouble. This signal is supplied to the main control section 400. In response to this signal, the main control section 400 stops, in step ST20, the power supplied to the electronic photographic unit 1 and the motors incorporated in the paper sheet feeder 2, releases the registration clutches involved, and starts serviceman call processing.

Figures 14A, 14B, 14C, 14D:
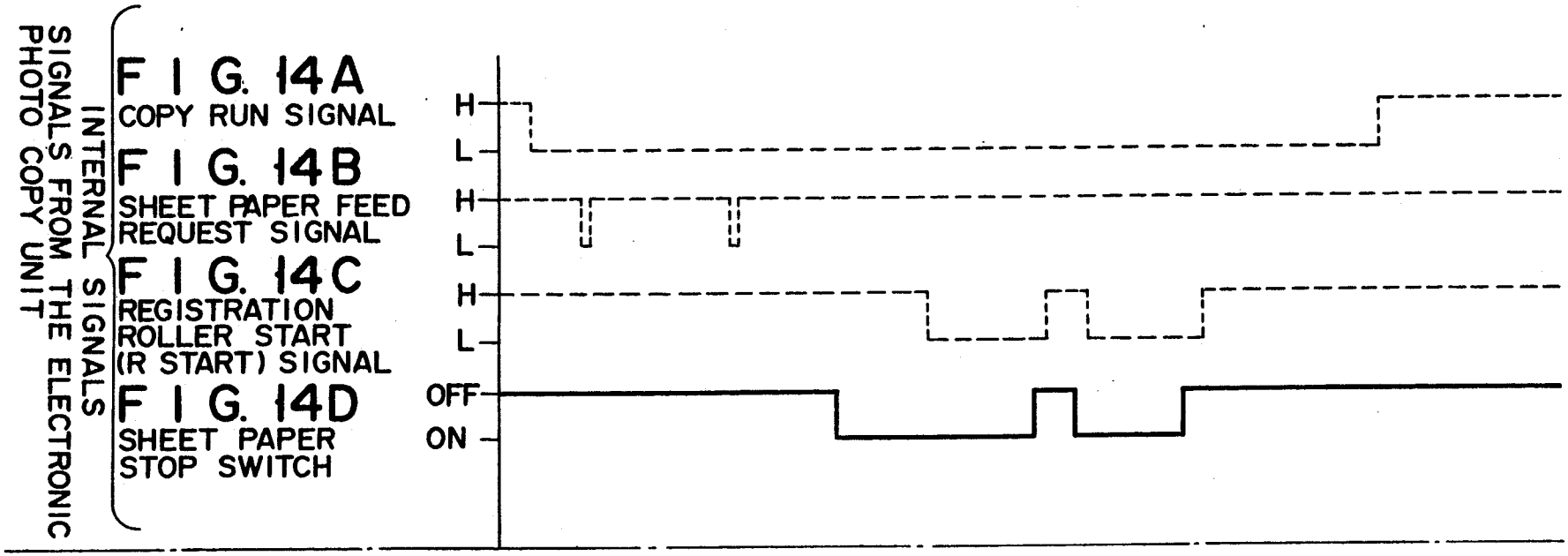

When it is determined in step ST11 that the emptiness-detecting switches 105, 115, and 125 are on, the control section 500 determines in step ST21 whether or not the copy-run signal supplied from the main control section 400 is at the low level as is shown in FIG. 14A. If YES in step ST21, the operation goes to step ST32 (later described). If NO in step ST21, the operation goes to step ST22, in which the section 500 determines whether or not a period of 2 seconds has lapsed after the trays 133*a*, 133*b* and 133*c* stop moving in step ST10. If YES, the control section 500 outputs in step ST23 a signal instructing that the trays be moved downwards. Upon lapse of 2 seconds after the start of the downward moving of the trays 133*a*, 133*b* and 133*c*, the control section 500 stops, in step ST25, the tray motor 151*a* which has been actuated by the driver 504, whereby the tray 133*a* is stopped.

In the next step ST26, the control section 500 determines whether or not the copy-run signal supplied from the the main control section 400 is at the low level. If NO, the door switches 520 and 521 are checked in step ST27 to make sure that either of the upper and lower side-door is open. If either door is open, the sequence of system run check returns to step ST5. If either door is closed, the sequence of system run check returns to the step ST26.

If YES in step ST26, that is, the copy-run signal is at the low level, or the copy key 61 of the control panel 5 is pushed, the paper sheet feeder 2 is set in the standby condition, and the original image on the document D can be copied. In step ST28, one of the trays 133*a*, 133*b* and 133*c* is moved upwards under the control of the section 500. Then, in step ST29, the control section 500 determines whether one of the tray-up switches 104, 114 and 124 is on or not. If YES, the corresponding tray motor 151*a*, 151*b* or 151*c* is stopped in step ST30, whereby the tray is stopped.

In step ST31 it is determined whether or not a period of 2 seconds has passed after one of the trays 133*a*, 133*b* and 133*c* is brought to a standstill or after the tray is moved upward even when the corresponding tray-up switch is off in step ST29. If YES in step ST31, or if the copy-run signal is at the low level in step ST21, the control section 500 determines in step ST32 whether or not the main motor 145 is on, which is actuated at the timing shown in FIG. 20B. If NO in step ST32, the control section 500 determines in step ST33 whether or not 0.3 second has elapsed since the level of the copy-run signal is at the low level. If NO in step ST33, the sequence of checking the system run returns to step ST29. If YES in step ST33, the driver 504 drives the main motor 145, and the operation returns to step ST29.

If it is determined in step ST31 that 2 seconds has lapsed after the the tray has been moved upward, the control section 500 outputs a signal indicating troubles, and supplies this signal to the main control section 400. In response to this signal, the main section 400 turns off ST31 the electronic photographic unit 1, the motors incorporated in the paper sheet feeder 2, and the registration clutches, in step ST35. Then, the serviceman-call processing is started In YES in step ST32, that is, if the main motor 145 is on, the control section 500 determines in step ST35 whether or not 0.3 second has lapsed since the main motor 145 started rotating. If NO, the sequence of checking the system run returns to step ST29. If YES, the control section 500 determines in step ST36 whether or not one of the tray motors 151*a*, 151*b* and 151*c* is driven. If YES in step ST36, the the sequence of checking the system run returns to step ST29. If NO in step ST36, the section 500 changes level of the paper-feeding ready signal to the low level in step ST37, as is illustrated in FIG. 15A.

Then, in step ST38, the control section 500 determines whether or not the sheet-feeding request signal is at the low level. If NO, the section 500 determines in step ST39 whether or not the copy production cycle is over, that is, whether or not the copy-run signal shown in FIG. 14A is at the high level. If NO in step ST39, the sequence of checking the system run returns to step ST38, placing the paper sheet feeder 2 in the standby condition. If YES in step ST38, the sequence of checking the system run goes to post paper-feeding processing.

In the post paper-feeding processing, the control section 500 energizes, in step ST40, one of the registration solenoids which are provided for the registration clutches 142, 143, and 144, respectively. As a result, one of these clutches is released as is shown in FIGS. 15C, 15D, and 15E, whereby one of the registration rollers 136, 137 and 138 is stopped and also the main motor 145 is stopped as specified in FIG. 15A. In step ST41, one of the trays 133*a* 133*b* and 133*c* is moved downwards as is shown in FIG. 15I.

Thereafter, the control section 500 determines in step ST42 whether or not the copying operation has started, more precisely whether or not the copy-run signal is at the low level of the L-level. If NO in step ST42, the section 500 determines in step ST43 whether or not 2 seconds have passed since one of the trays 133*a*, 133*b*, and 133*c* moved down. If NO in step ST43, the sequence of checking the system run returns to step ST41. If YES in step ST43, the section 500 de-energizes in step ST44 one of the drivers 504, 505 and 506, thereby stopping one of the tray motors 151*a*, 151*b* and 151*c* and, hence, stopping one of the trays 133*a*, 133*b* and 133*c*.

If YES in step ST42, that is, if the copying operation has started, the control section 500 de-energizes one of the drivers 504, 505 and 506, thereby stopping one of the tray motors 151*a*, 151*b* and 151*c*. As a result, one of the trays 133*a*, 133*b* and 133*c* stops moving in step ST45. Upon lapse of 50 milliseconds thereafter, the sequence of checking the system run returns, in step ST46, to the step ST28, and the paper sheet feeder 2 is set in the standby condition.

Further, if YES in step ST 38, that is, if a request for paper feeding has been made, the control section 500 changes in step ST47 the level of the paper-feeding ready signal to the high level as is shown in FIG. 15A, whereby the paper-feeding operation starts.

In the paper-feeding operation, the control section 500 actuates one of the feed clutches 103, 113 and 123, which corresponds to the selected one of the paper cassettes 15, 16 and 17, so that paper sheets P can be fed from the selected cassette. In step ST48, a paper sheet P is fed from the selected cassette 15, 16 or 17. More specifically, the control section 500 instructs one of the drivers 511, 512 and 513 to energize one of the feed solenoids, thereby actuating one of the feed clutches 103, 113 and 123, whereby the main motor 145 starts rotating. The rotation of the motor 145 is transmitted to one of the pickup rollers 100, 110 and 120, one of the sheet paper feed rollers 101, 111 and 121, and one of the sheet-separating rollers 102, 112 and 122. One of the pickup rollers thereby takes the uppermost sheet P from the selected paper cassettes 15, 16 and 17. Subsequently, one of the sheet paper feed rollers 101, 111 and 121, and one of the separator rollers 102, 112, and 122 are driven, feeding the paper sheet P into the paper transfer path 40.

Then, in step ST49, the control section 500 determines whether or not one end of the sheet P fed from the selected cassette abuts on and turns on one of the switches 139, 140 and 141. If NO in step ST49, the section 500 determines, in step ST50, whether or not 1.6 seconds have passed since one of the feed clutches 103, 113 and 123 was actuated. If NO, the sequence of checking the system run returns to step ST49. If YES, it is determined that that a paper jam is occurring, the operation goes to step ST63, in which measures are taken to remove the paper jam as will be described later.

If YES in step ST49, that is, if one end of the sheet P fed from the selected cassette abuts on and turns on one of the switches 139, 140 and 141, the control section 500 determines that the sheet P has reached one of the pairs of registration rollers 136, 137 and 148. In step ST51, a time delay is made which is equal to the time required for registration of the sheet P. Then, in step ST52, the control section 500 releases one of the feed clutches 103, 113 and 123, whereby the force generated by the main motor 145 is not transmitted to the pickup rollers 100, 110 and 120, the feed rollers 101, 111 and 121, or the separator rollers 102, 112 and 122. Hence, paper sheets P can no longer be fed from the cassettes 15, 16 and 17.

Next, in step ST53, the control section 500 instructs one of the drivers 508, 509, and 510 to energize one of the registration solenoids 514, 515 and 516. As a result, one of the registration clutches 142, 143 and 144 is turned on, whereby the rotation of the main motor 145 is transmitted to one of the respective pairs of registration rollers 136, 137 and 138. Hence, the paper sheet P is fed through the paper transfer path 38 by the aid of one of the pairs of registration rollers 136, 137 and 138.

Then, in step ST54, the control section 500 determines whether or not the sheet P abuts and turns on the switch 48. In other words, it determines whether or not the paper sheet P has reached one pair of registration rollers 137. If NO in step ST54 upon lapse of a predetermined time, the section 500 determines in step ST55 that a paper jam is occurring. Then, measures will be taken to remove the paper jam, as will be described later. It should be noted that the predetermined time required for registration of the sheet P varies, depending on the cassette from which the sheet P has been fed.

If YES in step ST54, that is, if the sheet P abuts and turns on the switch 48, a time delay is made in step ST56, which is equal to the time required for registration of the sheet P. Then, in step ST57, the control section 500 releases one of the registration clutches 142, 143, and 144, whereby the force generated by the main motor 145 is not transmitted to the pairs of registration rollers 136, 137 and 138. Hence, the the sequence of checking the system run returns to step ST37. As a result, one of the respective pairs of registration rollers 136, 137 and 138 stops rotating.

When the rear end of a paper sheet P leaves the paper-stopping switches 139, 140 and 141, the next paper sheet P can be fed from the selected cassette 15, 16 or 17. Hence, the level of the paper-feeding ready signal is changed over to the low level, as shown in FIG. 15A. Every time the level of the paper-feeding ready signal is changed to the low level, the main control section 400 supplies the control section 500 with a paper-feeding request signal specified in FIG. 14B. In other words, the main control section 400 supplies the paper-feeding request signal to the section 500, as many times as there are sheets of paper contained in the selected cassette.

To copy the same image on a plurality of sheets P, the sheets P must be fed to the electronic photographic unit 1, each spaced from from the preceding one by the distance set prior to the copying operation. Hence, while the preceding sheet P is passing through the gap between a pair of registration rollers 37 and undergoing registration, the sheet P remains in the paper transfer path 38. As long as the preceding paper sheet P is stopped at the rollers 37, the sheet P is likewise stopped in the path 38. The moment the preceding sheet P is moved from the rollers 37, the sheet P is moved toward the roller 38, spaced by said distance from the preceding sheet P. When the sheet paper stop switch 48 is found on, the main control section 400 determines that one end of the paper sheet P has reached the pair of registration rollers. If the level of a signal for starting the rotation of the registration rollers is changed to the low level at this time, the driver 404 energizes, in step ST59, the registration solenoid 405, thereby setting the registration clutch 406 into engagement with the main motor 406. As a result, the registration rollers are rotated, whereby the sheet paper P is supplied to the image-forming 12. The unit 12 forms the image formed on the document D, on the paper sheet P. The paper sheet P is ejected onto the copy tray 9.

In step ST60, the control section 500 determines whether the paper-stopping switch 48 is turned off or off. If YES, the main control section 400 releases, in step ST60, the registration clutch 406 upon a lapse of the time that the sheet P requires path completely through the pair of registration rollers. As a result, in step ST62, the force generated by the main motor 407 is no longer transmitted to the registration rollers 37. Therefore, the sequence of checking the system run returns to the step ST5858.

Now, it will be explained how a paper jam, if found at step ST7, ST50 or ST55, is removed. The control section 500 determines whether or not a paper sheet P stays in the paper transfer path 38 and located downstream of the site of paper jam. If NO, the section 500 outputs a jam signal to the main control section 400. On the other hand, if YES, the section 500 outputs a jam signal to the main control section 400 upon a lapse of a predetermined period after the paper-stopping switch 37 has supplied the section 500 with a signal indicating that the sheet P has passed by the switch 37. The predetermined period is between the time when the rear end of the sheet P passes by the switch 37 and the time when the sheet P is ejected onto the copy tray 9 after the original image has been formed on it.

Meanwhile, in step ST63, upon receipt of a jam signal, the main control section 400 turns off the electronic photographic unit 1, as well as the motors and the registration clutches—all incorporated in the paper sheet feeder 2. Then, in step ST64, the section 400 causes the display 68 to display the message of "PAPER JAM OCCURRING" and to show the blinking icon 86g. Thereafter, in step ST65, the control section 500 determines whether the switches 520 and 521 are on, indicating that both side-doors 18 and 19. If NO, step ST65 is repeated. If YES, the operation goes to step ST66. In step ST66, the section 500 determines whether or not the door switches 520 and 521 are off, indicating the that that the side doors 18 and 19 are closed. If NO in step ST66, step ST66 is repeated. If YES in step ST66, the operation goes to the next step ST67. In step ST67, the section 500 determines whether not the paper-stopping switches 139, 140 and 141 are on. If YES, the sequence of checking the system run returns to step ST65. If NO, the section 500 causes the main control section 400 to turn off the icon 86g showing the paper jam, in step ST68, and the sequence of checking the system run returns to step ST8.

When the emptiness-detecting switch 105 detects that the paper cassette 15 becomes empty, the control section 500 causes the tray 133a to move down. Upon a lapse of 2 seconds after the tray 133a has started moving downwards, the section 500 instructs the driver 504 to stop the tray motor 151a, whereby the tray 133a is stopped. Thereafter, the control section 500 outputs a signal denoting that the cassette 15 is empty. This signal is supplied to the main control section 400. In response to this signal, the section 400 determines that the paper cassette 15 contains no paper sheets P, and causes the display 68 to display a message of "REPLENISH SHEETS" and also showing the blinking icon 86a indicating that the cassette 15 is empty.

When the control section 500 determines that the cassette 16 or 17 is empty, though neither the emptiness-detecting switch 115 nor 125 is turned on, it operates in the same way as in the case where it determines that there are no sheets P in the paper cassette 15, except that the icon 86b or 86c is displayed, showing that the cassette 16 or 17 is empty.

When a paper sheet P supplied from the cassette 15 is fed forward by the pair of registration rollers 37, the sheet P is subjected to registration performed by means of the pair of registration rollers 136, and then is fed further forward by means of the pair of registration rollers 137 and the pair of registration rollers 138. In this case, the rollers 137 and 138 function as as transfer rollers.

When a paper sheet P supplied from the cassette 16 is fed forward by the pair of registration rollers 37, the sheet P is subjected to registration by means of the pair of registration rollers 137 and is further fed forward by means of the pair of registration rollers 138. In this case, the rollers 138 are used as transfer rollers.

When a sheet paper P supplied from the paper cassette 17 is fed forward by the pair of registration rollers 37, the sheet P is subjected to registration by means of the pair of registration rollers 138.

The main control section 400 controls the image forming operation in accordance with the size of the paper sheet P selected by operating the control panel. If a paper sheet P supplied from one of the cassette 15, 16 and 17 delays in reaching the registration rollers 37, due to slippage or the like, the sheet P fails to reach the image-forming unit 1 at the time when the image-forming operation is started. In this case, the sheet P is held for one image-forming period, and the registration rollers 37 are driven such that the sheet P reaches unit 1 shortly before the image-forming operation begins.

It will now be described how the tray 133a is moved downwards whenever the cassette 15 is inserted into the holder, thereby to detect troubles, if any, in the paper sheet feeder 2.

When the the paper cassette 15 inserted into the holder 95 provided within the lower unit 2A the lock member 180 of the cassette 15 pushes up the arm lever 183, whereby the pickup roller 11 moves down. As a result of this, the tray-up switch 104 is turned off, whereas the cassette switch 182a is turned on. Upon detecting that the switch 182a is turned on, the control section 500 determines that the paper cassette 15 has set in the holder 95. Then, the section 500 instructs the tray motor 151a to rotate in the reverse direction for a certain period, moving the tray 133a downwards. Thereafter, the control section 500 determines whether or not the tray-up switch 104 is on. If YES, the section 500 determines that the pickup roller 11 has not descended to a given position, due to insufficient coupling between the lock member 180 and the arm lever 183, or that the tray 133a has moved up to a given position, pushing up the pickup roller 100. In this case, no further operation is performed, and the section 500 supplies a signal to the main control section 400, said signal indicating that there is a trouble with the tray. In response to this signal, the section 400 causes the display 86 to display the message of "TROUBLE IN THE TRAY."

If tray-up switch 104 is off, the control section 500 instructs the motor 151a to rotate in the forward direction, whereby the tray 133a moves up. The paper sheet P on the tray 133a is thereby brought into contact with the pickup roller 100. Subsequently, the roller 100 is pushed up, and the tray-up switch 104 is hence actuated with the pickup arm 187. Upon detecting that the tray-up switch 104 is actuated, the control section 500 stops the tray motor 151a. The tray 133a is halted, accordingly. The position of the tray 133a thus stopped is the place where the feeding of the sheet P is started.

At this time, if the paper sheet P is found on the tray 133a, the actuator 186 located at the middle portion of the pickup roller 100 is detected by the switch 105. In this case, it is determined that sheet P exists on the tray 133a. On the other hand, if no sheets P are found on the tray 133a, the actuator 186 slips into a hole made in the tray 133a, whereby the tray 133a is not move up to the position where the emptiness-detecting switch 105 can detect whether or not the paper is staying on the tray. In this case, it is determined that no paper sheets P are placed on the tray 133a.

In the case where the lock member 180 fails to push the arm lever 183 insufficiently upwards, neither the on-position nor off-position of the tray-up switch 104 be detected once the tray 133a has been moved down. The switch 104 remains on, and the tray 133a cannot be moved up. Thus, it is impossible for the section 500 to determine that there is a sheet P on the tray 133a.

As long as the tray 133a of the paper cassette 15 remains in an incomplete operating state, the tray 133a cannot be securely coupled with the drive mechanism associated with it, or the pickup roller cannot completely retreat. As a result, the tray 133a moves down before it moves up, whereby the trouble is detected The drive mechanism is therefore prevented from malfunctioning and is protected against damages.

In the foregoing, it has been described how it is determined whether trouble is occurring in the paper sheet feeder 2 while the feeder is feeding sheets P from the lower cassette 15. Trouble occurring in the feeder 2 while the sheets P are being fed from the other cassette 16 or 17 can be detected in the same way, thereby preventing the malfunction of the drive mechanism and damage thereto.

As described above, the paper sheet feeder 2 is designed to feed paper sheets P of difference sizes from the selected one of the cassettes 15, 16 and 17 to the image transfer section 35 (or the image-forming section) incorporated in the image-forming unit 1. The feeder 2 comprises three paper cassettes 15, 16 and 17, three pickup rollers 100, 110 and 120 for picking up sheets P from the cassettes 15, 16 and 17, respectively, a paper transfer path 40 connecting the cassettes 15, 16 and 17 to the image transfer section 35, a pair of registration rollers 136 for aligning a sheet P supplied from the cassette 15, a pair of registration rollers 137 for aligning a sheet P supplied from the cassette 16, and a pair of registration rollers 138 for aligning a sheet p supplied from the cassette 17. Since the sheet P is aligned after it has been supplied from any cassette, the sheet P, if having a skew or displaced off the center, can be registered correctly immediately before reaching the image transfer section 35. Hence, the image of the document D can be reproduced on the sheet P at a correct position. The paper sheet feeder 2 can therefore serve to make a high-quality copy, unlike the conventional paper sheet feeder.

Further, since a sheet P supplied from any cassette is not supplied toward the image transfer section 35 before a predetermined period lapses after its front end abuts on the registration rollers and the rear end of the preceding sheet P is detected is detected by a paper-stopping switch. Therefore, sheets P can be fed, one after another, to the image transfer section 3S at regular intervals, even if they are of different sizes and are supplied form different cassettes. Hence, the paper sheet feeder 2 needs no detectors for detecting the sheets P fed from the cassettes, and is simple in structure.

As has been described, the tray motor 151a, 151b or 151b is rotated when the power switch of the image forming apparatus A is turned on, thereby moving up the tray 133a, 133b or 133c, thereby to detect whether or not a sheet of paper P exists on the tray 133a, 133b or 133c. Further, whenever the cassette 15, 16 or 17 is inserted into the holder, the tray motor 151a, 151b or 151c is driven in response to a signal output by the switch 182a, 182b or 182c, thus moving up the tray 133a, 133b or 133c, whereby it is determined whether or not a sheet P exists on the tray 133a, 133b or 133c. Hence, expensive sensors or complex mechanisms are required to detect the presence or absence of a sheet P on each tray.

Further, since the trays 133a, 133b and 133c are vertically movable within the respective sheet paper cassettes 15, 16 and 17, they can move up to the pickup rollers 100, 110 and 120, respectively, when the copy key 61 is pushed. Also, the trays 133a, 133b and 133c can move down, each to a standby position, upon completion of producing a desired number of copies.

Noises made by any cassette being pulled from the holder is relatively small. This is because the tray (133a, 133b or 133c) is moved down by driving the tray motor (151a, 151b or 151c) in reverse direction in advance. Further, the pickup rollers are prevented from being deformed despite of the contacts with individual sheet P. Nor are sheets P warped or folded. Hence, sheets P do not overlap, reducing the possibility of paper jams.

Further, with the present invention it is possible to write into a non-volatile memory the data items representing the sizes and feed directions of the paper sheets P contained in the cassettes 15, 16 and 17 that are inserted in the feeder 2. This not only makes it unnecessary to use switches for detecting the sizes of the sheets supplied from any of the cassettes and the feeding directions of these sheets P, but also prevent errors from being made by the operator. Even if after the cassettes 15, 16 and 17 are pulled from the feeder 2, said data items are preserved.

If the paper sheet feeder 2 has a trouble, such as paper jam, the sheet P located downstream of the site of paper jam, the feeder 2 supplies a paper-jam signal to the electronic photographic unit 1 after the sheet P has undergone image-forming process and ejected onto the tray 9. Hence, the paper sheet P, which is located upstream of the site of the paper jam, is prohibited from being fed forward. Therefore, the sheet P located downstream of the paper-jam site is not wasted, unlike in the conventional paper sheet feeder which has a paper transfer path as long as the path 38 of the feeder 2 and in which the electronic photographic unit is stopped the moment a paper jam occurs in the paper transfer path.

To form the original image on the first sheet P fed by the paper sheet feeder 2, the electronic photographic unit 1 starts performing its function in response to a signal output from the paper-stopping switch 37. To form the original image on the second sheet P and the succeeding sheets P, the unit 1 repeats the image-forming process at regular intervals, each time on one paper sheet P. If the first sheet P fails to reach the paper-stopping switch 37 within a predetermined period, a paper jam is detected. If the any sheet P, except the first sheet P, arrives at the paper-stopping switch 37 with some delay, that is, if the distance between any two adjacent sheets P, except for the first sheet P, is longer than the distance corresponding to said regular interval, the unit 1 perform image-forming operation in the next cycle. In other words, the unit 1 does not perform image-forming operation whenever a sheet P arrives with a time delay, and performs the image-forming operation in the next cycle on the sheet P. Thus, even if the sheet P arrives at the unit 1 later than the desired timing due to slipping or an other trouble, which may sometimes occur in the feeder 2, the original image is formed on the sheet P in the next image-forming cycle, not wasting the sheet P.

As is described above, it is after the last sheet P leaves any cassette that the cassette is found to be empty. Hence, if the cassette is pulled from the feeder 2 immediately after it is found empty, the last sheet P is not drawn back at all, and there is no possibility of paper jam. 1

As has been described, any tray 113*a*, 113*b* or 113*c* is moved down and then moved upward after the operator replenishes sheet papers P in the cassette 15, 16 or 17. Before being moved up, the tray is moved further downwards after the sheets P have been replenished in the cassette. The tray-up switch 104, 114 or 124 detects whether the pickup roller 100, 110 or 120 moves up as the tray is moved downwards. If the switch 104, 114 or 124 detects that the pickup roller moves up, it is determined that the feeder 2 has a trouble. In this case, no further operations are carried out the paper sheet feeder 2. Hence, the feeder 1 does not malfunction, or any component thereof is not damaged at all, even when any tray fails to move up or down due to insufficient coupling between the tray and the motor, or even when any pickup roller fails to contact the tray since the roller is in a retreated position.

The present invention is not limited to the embodiment described above. Various changes and modifications can be made within the spirit and the scope of the present invention.

As as been explained, in the paper sheet feeder of the present invention, each paper sheet is registered reliably, immediately after it has been picked up by the pickup roller and fed from the selected cassette. Hence, the sheet does not have a skew or is not displaced sideways when it reaches the image transfer section. Thus, the use of the feeder serves to form a high-quality image on a paper sheet, neither displaced nor deformed.

What is claimed is:

1. A paper sheet feeder comprising:

first storing means for storing a first group of paper sheets;

second storing means for storing a second group of paper sheets;

first taking-up means for taking up the first group of paper sheets one by one from said first storing means;

first transferring means for transferring the first paper sheets supplied from said first storing means;

second taking-up means for taking up the second group of paper sheets one by one for said second storing means;

second transferring means for transferring the second paper sheets to said first transferring means from said second storing means, said first transferring means transferring the second paper sheets transferred from said second transferring means;

selecting means for selecting one of said first or second taking-up means to energize the selected one of said first or second taking-up means; and means for causing one of said first or second transferring means corresponding to the selected one of said first or second taking-up means to prevent the corresponding paper sheet from passing therethrough and to register the corresponding paper sheet in a predetermined orientation.

2. A paper sheet feeder according to claim 1, further comprising:

common registering means for registering the selected paper sheet transferred from said first transferring means in a predetermined orientation.

3. A paper sheet feeder according to claim 1, further comprising detecting means for detecting no paper sheets in said first storing means to generate a first empty signal and no paper sheets in said second storing means to generate a second empty signal.

4. A paper sheet feeder according to claim 3, further comprising:

display means for displaying an icon to indicate failure to receive paper sheets in said first and/or second storing means in response to the first or second empty signal.

5. A paper sheet feeder according to claim 1, wherein each of said first and second taking-up means comprises a pickup roller for picking up paper sheets, a pair of feed rollers for feeding the picked-up paper sheet, and a clutch for controlling the operations of the pickup roller and feed rollers.

6. A paper sheet feeder according to claim 5, wherein each of said first and second storing means includes pushing means for pushing paper sheets toward the pickup roller.

7. A paper sheet feeder according to claim 6, wherein each of said first and second storing means includes detecting means for detecting whether paper sheets are pushed up to a predetermined point.

8. A paper sheet feeder according to claim 7, wherein each of said first and second transferring means includes a stop switch for stopping the transfer of a paper sheet so that the paper sheet is registered by the stop switch.

9. A sheet paper feeder comprising:

a first storing means for storing a first group of sheet papers;

second storing means for storing a second group of sheet papers;

selecting means for selecting either said first or second group of paper sheets and for generating a corresponding first or second energizing signals;

means for defining a transfer path in which the paper sheets are guided;

first pick-up means for picking up the first group of paper sheets one by one from said first storing means in accordance with the first energizing signal;

second pick-up means for picking up the second group of paper sheets one by one from said second storing means in accordance with the second energizing signal;

first registering means, located in the transfer path, for registering a first paper sheet supplied from said first pick-up means in a proper orientation and transferring the first paper sheet in the transfer path in accordance with the first energizing signal and transferring the second paper sheets in the transfer path in accordance with the second energizing signal;

second registering means, located downstream of said first registering means in the transfer path, for registering a second paper sheet supplied from said first pick-up means in the proper orientation and transferring the second paper sheet in the transfer path in accordance with the second energizing signal; and third registering means, located downstream from said first registering means in the transfer path, for registering the selected paper sheet transferred from said first registering means in a predetermined orientation.

10. A paper sheet feeder according to claim 9, further comprising detecting means for detecting no first paper sheet received in said first storing means to generate a first empty signal and no second paper sheet received in said second storing means to generate a second empty signal.

11. A paper sheet feeder according to claim 10, further comprising:

display means for displaying no first and second paper sheets received in said first and second storing means, in response to the first and second empty signals.

12. A paper sheet feeder according to claim 9, wherein each of said first and second picking-up means includes a pickup roller for picking up paper sheets one by one, a pair of feed rollers for feeding the picked-up paper sheet, and a clutch for controlling the operations of the pickup roller and feed rollers.

13. A paper sheet feeder according to claim 12, wherein each of said first and second storing means includes pushing means for pushing paper sheets toward the pickup roller.

14. A paper sheet feeder according to claim 13, wherein each of said first and second storing means includes detecting means for detecting whether paper sheets are pushed up to a predetermined point.

15. A paper sheet feeder according to claim 14, wherein each of said first and second registering means includes a stop switch for stopping the transfer of the first or second paper sheet so that the paper sheet is registered in the predetermined orientation.

16. An image forming apparatus comprising: first storing means for storing a first group of paper sheets papers;

second storing means for storing a second group of paper sheets papers;

first taking-up means for taking up the first group of paper sheets one by one from said first storing means;

first transferring means for transferring the first group of paper sheet supplied from said first storing means;

second taking-up means for taking up the second group of paper sheets one by one for said second storing means;

second transferring means for transferring the second paper sheet to said first transferring means from said second storing means, said first transferring means transferring the second paper sheets transferred from said second transferring means;

selecting means for selecting one of said first and second taking-up means to energize the selected one of said first-and second taking-up means;

means for causing one of said first and second transferring means which corresponds to the selected one of said first and second taking-up means to prevent the corresponding paper sheet from passing therethrough and to register the corresponding paper sheet in a predetermined orientation; and forming means for forming an image on the paper sheet transferred from said first transferring means.

* * * * *